US007386262B2

(12) United States Patent
Okamura et al.

(10) Patent No.: US 7,386,262 B2
(45) Date of Patent: Jun. 10, 2008

(54) BELT DRIVING CONTROL APPARATUS AND IMAGE FORMING APPARATUS WHICH USES A MOVING AVERAGE PROCESS AND A REVOLUTION AVERAGE PROCESS

(75) Inventors: Hiroshi Okamura, Kanagawa (JP); Yuji Matsuda, Tokyo (JP); Hiromichi Matsuda, Kanagawa (JP); Toshiyuki Andoh, Kanagawa (JP); Nobuto Yokokawa, Kanagawa (JP); Ryoji Imai, Kanagawa (JP); Masato Yokoyama, Kanagawa (JP); Kazuhiko Kobayashi, Tokyo (JP); Yohei Miura, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 125 days.

(21) Appl. No.: 11/335,657

(22) Filed: Jan. 20, 2006

(65) Prior Publication Data

US 2006/0182471 A1 Aug. 17, 2006

(30) Foreign Application Priority Data

Jan. 25, 2005 (JP) ..... 2005-047909

(51) Int. Cl.
*G03G 15/01* (2006.01)

(52) U.S. Cl. ..... 399/298; 399/302; 399/303

(58) Field of Classification Search ..... 399/298, 399/299, 302, 303, 301
See application file for complete search history.

(56) References Cited

U.S. PATENT DOCUMENTS 6,038,423 A 3/2000 Tagawa et al.
2004/0086299 A1 5/2004 Matsuda et al.
2006/0165442 A1* 7/2006 Kobayashi et al. ..... 399/301
2006/0182471 A1* 8/2006 Okamura et al. ..... 399/298
2006/0184258 A1* 8/2006 Matsuda et al. ..... 700/56
2006/0285887 A1* 12/2006 Matsuda ..... 399/302

FOREIGN PATENT DOCUMENTS

| | | |
|---|---|---|
| EP | 1 031 887 A2 | 8/2000 |
| EP | 1 225 484 A2 | 7/2002 |
| JP | 5-89455 | 4/1993 |
| JP | 8-234531 | 9/1996 |
| JP | 11-174932 | 7/1999 |
| JP | 2000-310897 | 11/2000 |
| JP | 2001-16883 | 1/2001 |
| JP | 2003-177588 | 6/2003 |
| JP | 3564953 | 6/2004 |
| JP | 3677506 | 5/2005 |

OTHER PUBLICATIONS

U.S. Appl. No. 11/203,309, filed Aug. 15, 2005, Matsuda et al.
U.S. Appl. No. 11/334,630, filed Jan. 19, 2006, Kobayashi et al.
U.S. Appl. No. 11/335,657, filed Jan. 20, 2006, Okamura et al.
U.S. Appl. No. 11/867,426, filed Oct. 4, 2007, Kobayashi et al.

* cited by examiner

*Primary Examiner*—Quana M Grainger
(74) *Attorney, Agent, or Firm*—Oblon, Spivak, McClelland, Maier & Neustadt, P.C.

(57) ABSTRACT

A belt driving control apparatus, the belt driving control apparatus having an endless belt, a driving roller driving the endless belt, a driving motor driving the driving roller, at least one idler roller being dependent on the endless belt, and an encoder attached to one idler roller. The belt driving control apparatus includes a structure where a control target value of the driving motor is set so that an effective speed of the endless belt is constant and the driving motor is drive-controlled so that the control target value is satisfied.

9 Claims, 24 Drawing Sheets

FIG.24

| COEFFICIENT | VALUE |
|---|---|
| a11= | 8173 |
| a21= | -2225 |
| b01= | 133 |
| b11= | 266 |
| b21= | 133 |
| a12= | 10389 |
| a22= | -5050 |
| b02= | 11022 |
| b12= | 22045 |
| b22= | 11022 |

| | |
|---|---|
| ISF | 2240 |
| dformat | 13 |

BELT DRIVING CONTROL APPARATUS AND IMAGE FORMING APPARATUS WHICH USES A MOVING AVERAGE PROCESS AND A REVOLUTION AVERAGE PROCESS

BACKGROUND OF THE INVENTION

1. Field of the Invention

The present invention generally relates to belt driving control apparatuses and image forming apparatuses, and more specifically to a belt driving apparatus configured to control driving of an endless belt such as a transferring conveyance belt used for a transferring apparatus or the like of a color image forming apparatus, and an image forming apparatus, such as a color printer or color copier, having the belt driving control apparatus.

2. Description of the Related Art

There are two methods, a direct transferring method and an intermediate transferring method, as general methods for forming a color image in an image forming apparatus. In the direct transferring method, toner images having different colors and formed on plural photosensitive bodies are directly superposed (overlapped) on a transferring paper so that transferring is made. In the intermediate transferring method, the toner images having different colors are transferred to an intermediate transferring body and then transferred to the transferring paper in a lump (superposed). These methods are called tandem methods because plural photo sensitive bodies are commonly arranged in line so as to face the transferring paper or the intermediate transferring body in these methods. An electrophotographic process such as forming an electrostatic latent image or developing is implemented to for respective yellow (Y), magenta (M), cyan (C) and black (K) colors for the photosensitive body. In the direct transferring method, transferring is made onto the running transferring paper. In the intermediate transferring method, transferring is made onto the running intermediate transferring body.

It is general practice, in a tandem type color image forming apparatus that an endless belt, which runs while carrying the transferring paper, be used in the direct transferring method, and an endless belt which receives and carries the image from the photosensitive body be used in the intermediate transferring method. An image forming unit including four photosensitive bodies is arranged in line along a running side of the endless belt.

In the above-discussed tandem type color image forming apparatus, it is important to securely stack (superpose) toner images of respective colors so that generation of a color registration is prevented. Because of this, in order to prevent such a color registration due to the speed variation of the transferring belt, in either transferring method, an encoder is provided at one of plural dependent shafts forming the transferring unit and the rotational speed of the driving roller is feed-back controlled as corresponding to the rotational speed variation of the encoder.

As a most general method for realizing such a feed back control, a proportional control (PI control) is used. In this control, first, a position deviation e(n) is computed from a difference between an object angular displacement Ref(n) of the encoder and the detection angular displacement P(n-1) of the encoder. Then, a low-pass filter is applied to the position deviation e(n) that is a computed result so that high frequency noise is eliminated, a control gain is applied, and a certain standard driving pulse frequency is added. By controlling the driving motor by using the obtained driving pulse frequency, it is possible to control the encoder output so that the encoder output is driven at an object angle deformation.

In actual control, a counter for counting a starting edge of an output of the encoder pulse and a counter for counting a control cycle such as 1 ms are used. The position deviation can be obtained based on the difference between a computing result of the object angle deformation moving during a control cycle (1 ms) and a detection angle deformation obtained by obtaining the encoder count value every the control cycle.

More specifically, the following computing is implemented under a condition that the roller diameter of a dependent shaft where the encoder is attached is 15.615 mm.

$$e(n)=\theta 0\times q-\theta 1\times ne \text{ [rad]}$$

Here, e(n)[rad] represents a position deviation computed by sampling this time. θ0[rad] represents a moving angle per a control cycle and is equal to $2\pi\times V\times 10^{-3}/15.615\pi$[rad]. θ1[rad] represents a moving angle per encoder 1 pulse and is equal to 2π/p[rad] wherein p represents a slit pitch of the encoder. "q" represents a count value of a control cycle timer. "ne" represents an encoder count value. "V" represents a belt linear speed [mm/s].

For example, 300 pulses per one rotation are used as a resolution of the encoder at a control cycle of 1 ms. The feed back control is applied so that the transferring belt is moved at 162 mm/s. As a result, θ0 and θ1 are calculated as follows.

$$\theta 0=2\pi\times 162\times 10^{-3}/15.615\pi=0.0207487\text{[rad]}\theta 1=2\pi\times p=2\pi/300=0.0209439\text{[rad]}$$

The above-mentioned computing is performed every control cycle so that the position deviation is obtained and the feed back control is implemented.

However, in this method, the conveyance speed of the transferring paper is changed due to the minute thickness of the conveyance belt so that the image is shifted from the ideal position and the image quality is degraded. Furthermore, the image is changed between plural recording papers so that the repeated reproducibility of the image forming position between the recording papers is degraded.

Assuming that the conveyance speed is determined in the center of the belt thickness, the belt conveyance speed V is calculated as follows.

$$V=(R+B/2)\times\omega$$

Here, R represents a driving roller radius, B represents a belt thickness, and ω is an angular speed of the driving roller.

Meanwhile, FIG. 1 is a view showing the relationship between a belt thickness B of the conveyance belt and a belt driving effective radius r for explaining problems of the related art. As shown in FIG. 1, as the belt thickness B of the conveyance belt 50 is changed, a position of an effective line of the belt thickness shown by a dotted line is changed. This means, the belt driving effective radius "r" is changed. Since "R+B/2" is changed, even if the angular speed ω of the driving roller 51 is constant, the belt conveyance speed is changed. In other words, even if the driving roller 51 is rotated so that the anglar speed is constant, as long as the belt thickness is changed, the belt conveyance speed is changed.

FIG. 2 is a view showing a model of a driving conveyance system of the conveyance belt 50 wound around a driving roller 51, an idler roller 52, and a tension roller 53. FIG. 3 is a graph showing a belt thickness displacement and a belt speed variation in a single circle of the conveyance belt 50 in a case where the driving roller 51 is rotated at a certain angular speed. In a case where a thick part of the conveyance belt 50 is in contact with the driving roller 51, as shown in FIG. 1, the belt driving effective radius r at the driving position is increased so that the belt conveyance speed is increased. On the other hand, when a thin part of the conveyance belt 50 is in contact with the driving roller 51, the belt conveyance speed is decreased.

FIG. 4 is a graph showing a belt thickness displacement at the idler roller 52 and a belt speed variation detected at the idler roller 52 when the conveyance belt 50 is conveyed at a certain speed. Even if the conveyance belt 50 is conveyed ideally without any speed variation, in a case where a thick part of the belt is in contact with the idler roller 52, the dependent effective radius "r" is increased so that the angular speed of the idler roller 52 is reduced. This is detected as a reduction of the belt conveyance speed. Furthermore, in a case where a thin part of the belt is in contact with the idler roller 52, the angular speed of the idler roller is increased and this is detected as an increase of the belt conveyance speed.

Thus, in a case where the thickness of the belt is changed, if the belt conveyance speed is detected by the angular displacement of the idler roller by using an encoder or the like, an error detection element is generated. Because of this, even if the belt is conveyed at a certain speed, due to the belt thickness displacement, the conveyance belt is detected as through the conveyance speed is changed, by the angular displacement detection of the idler roller (dependent shaft). In addition, in the above-mentioned dependent shaft feed back control, it is not possible to implement the control with high precision considering such a belt thickness displacement.

Japanese Laid-Open Patent Application Publication No. 2000-310897 discloses a method for solving such a problem caused by the belt thickness displacement. More specifically, Japanese Laid-Open Patent Application Publication No. 2000-310897 discloses a speed profile to compensate for a speed variation Vh that is expected to be generated due to the known thickness profile that extends over a whole periphery direction of a conveyance belt that is measured beforehand with a position detected by a belt mark as a standard when a driving roller is driven at a constant pulse rate; a driving motor control signal that is a modulated pulse rate against the speed variation is generated; and an oscillating motor is driven based on this and a conveyance belt is driven through the driving roller. Thus, a final speed Vb of the conveyance belt is made to be one without any variation in speed.

However, in the method disclosed in Japanese Laid-Open Patent Application Publication No. 2000-310897, the speed profile data requires data every control cycle. Hence, in a case where the control cycle is a short cycle, a large amount memory is required. In addition, in a case where the control cycle is a short cycle, the feed back control per se cannot obtain a sufficient effect. For example, in a case where the belt circumference length is 815 mm, the belt driving speed is 125 mm/s, and the control cycle is 1 ms, control of 6520 times per the belt going around one time (one revolution) is necessary, as the following formula indicates.

$$815\ \text{mm}/(125\ \text{mm/s}\times 1\ \text{ms})=6520$$

In addition, if the belt thickness per one point is expressed by 16 bits, a memory having 100 Kb and more is necessary, as the following formula shows.

$$6520\times 16\ \text{bit}=104320\ \text{bit}$$

Because of this, in a case where the above-mentioned control is performed by an actual image forming apparatus, a nonvolatile memory is required to be prepared as a memory for storing the belt thickness profile. Even if data are compressed and stored, and the data are expanded and loaded in a volatile memory at the time when the electric power is turned on, the large amount memory is still necessary. Because of this, a separate memory in addition to the memory used as a normal work area is necessary so that an undesirable large increase of the cost happens.

Furthermore, in the method discussed in Japanese Laid-Open Patent Application Publication No. 2000-310897, it is necessary to measure the thickness of the belt at the entire circumference as profile data of the thickness of the belt, and therefore the thickness is measured by a laser displacement gauge. Measurement data are input by input means such as an operation panel operated by a service person or at the time when the product is shipped. However, measuring means having high precision is required to measure the change of the thickness of several μm of the belt. In addition, data management of the measured result is complex. Furthermore, since the amount of data is large, an input error may be generated.

SUMMARY OF THE INVENTION

Accordingly, it is a general object of the present invention to provide a novel and useful belt driving control apparatus and image forming apparatus.

The above object of the present invention is to provide a belt driving control apparatus configured to control the driving of an endless belt and an image forming apparatus having the belt driving control apparatus, whereby stability of speed variation generated by the change of the belt thickness can be securely made in a simple structure.

It is also an object of the present invention to provide a belt driving control apparatus, the belt driving control apparatus having an endless belt, a driving roller driving the endless belt, a driving motor driving the driving roller, at least one idler roller being dependent on the endless belt, and an encoder attached to one of the idler roller, the belt driving control apparatus having a structure where a control target value of the driving motor is set so that an effective speed of the endless belt is constant and the driving motor is drive-controlled so that the control target value is satisfied, the belt driving control apparatus including:

a mark detection part configured to detect a mark provided on the endless belt as a standard position;

an angular displacement error detection part configured to detect an angular displacement error of the encoder generated by thickness variations of the endless belt;

a first computing part configured to calculate a maximum amplitude and a phase of a wave of the thickness variations of the endless belt at the mark from the angular displacement error of the encoder obtained by the angular displacement error detection part;

a second computing part configured to calculate correction data corresponding to a distance from the mark based on a value stored in the non-volatile memory;

a storage device configured to store the calculation result of the first computing part and the correction data; and a driving motor control part configured to make speed variations due to thickness displacement of the endless belt stable by adding the correction data to the control target value for driving control at the time of driving the driving motor;

wherein the first computing part implements a moving average process and a revolution average process of data of the angular displacement error of the encoder detected by a plurality of revolutions of the endless belt so that data of the angular displacement error of the encoder of one revolution of the belt is calculated, and a phase and a maximum amplitude at the mark of the wave of the thickness displacement of the endless belt are calculated from data of the calculated angular displacement error.

It is also on object of the present invention to provide a belt driving control apparatus, the belt driving control apparatus having an endless belt, a driving roller driving the endless belt, a driving motor driving the driving roller, a plurality of idler rollers being dependent on the endless belt, and an encoder attached to one of the idler rollers, the belt driving control apparatus having a structure where a control target value of the driving motor is set so that an effective speed of the endless belt is constant and the driving motor is drive-controlled so that the control target value is satisfied, the belt driving control apparatus including:

mark detection means for detecting a mark provided at the endless belt as a standard position;

angular displacement error detection means for detecting an angular displacement error of the encoder generated by thickness variations of the endless belt;

first computing means for calculating a maximum amplitude and a phase of a wave of the thickness variations of the endless belt at the mark from the angular displacement error of the encoder obtained by the angular displacement error detection means;

a non-volatile memory configured to store the calculation result of the first computing means;

second computing means for calculating correction data corresponding to a distance from the mark based on a value stored in the non-volatile memory;

a volatile memory configured to store the correction data; and driving motor control means for making speed variations due to thickness displacement of the endless belt stable by adding the correction data to the control target value for driving control at the time of driving the driving motor;

wherein the first computing means implements a moving average process and a revolution average process of data of the angular displacement error of the encoder detected by a plurality of revolutions of the endless belt so that data of the angular displacement error of the encoder of one revolution of the belt is calculated, and a phase and a maximum amplitude at the mark of the wave of the thickness displacement of the endless belt is calculated from data of the calculated angular displacement error.

It is also an object of the present invention to provide an image forming apparatus, including:

a belt driving control apparatus, the belt driving control apparatus having an endless belt, a driving roller driving the endless belt, a driving motor driving the driving roller, a plurality of idler rollers being dependent on the endless belt, and an encoder attached to one of the idler rollers, the belt driving control apparatus having a structure where a control target value of the driving motor is set so that an effective speed of the endless belt is constant and the driving motor is drive-controlled so that the control target value is satisfied, the belt driving control apparatus comprising:

a mark detection part configured to detect a mark provided on the endless belt as a standard position;

an angular displacement error detection part configured to detect an angular displacement error of the encoder generated by thickness variations of the endless belt;

a first computing part configured to calculate a maximum amplitude and a phase of a wave of the thickness variations of the endless belt at the mark from the angular displacement error of the encoder obtained by the angular displacement error detection part;

a non-volatile memory configured to store the calculation result of the first computing part;

a second computing part configured to calculate correction data corresponding to a distance from the mark based on a value stored in the non-volatile memory;

a volatile memory configured to store the correction data; and a driving motor control part configured to make speed variations due to thickness displacement of the endless belt stable by adding the correction data to the control target value for driving control at the time of driving the driving motor;

wherein the first computing part implements a moving average process and a revolution average process of data of the angular displacement error of the encoder detected by a plurality of revolutions of the endless belt so that data of the angular displacement error of the encoder of one revolution of the belt is calculated, and a phase and a maximum amplitude at the mark of the wave of the thickness displacement of the endless belt is calculated from data of the calculated angular displacement error.

According to the above-discussed driving control apparatus or image forming apparatus, stability of speed variation generated by the change of the belt thickness can be securely made in a simple structure in a case where the conveyance speed of the endless belt wound around the driving roller and the idler roller is controlled by using a detection signal by the encoder attached to the idler roller. In addition, it is possible to perform proper processing corresponding to image quality so that good feed back control can be done.

Other objects, features, and advantages of the present invention will become more apparent from the following detailed description when read in conjunction with the accompanying drawings.

BRIEF DESCRIPTION OF THE DRAWINGS

FIG. 24 is a table showing filter coefficients of the filter used in the embodiment of the present invention;

DETAILED DESCRIPTION OF THE PREFERRED EMBODIMENTS

A description of the present invention is now given, with reference to FIG. 5 through FIG. 30, including embodiments of the present invention.

Figure 6:
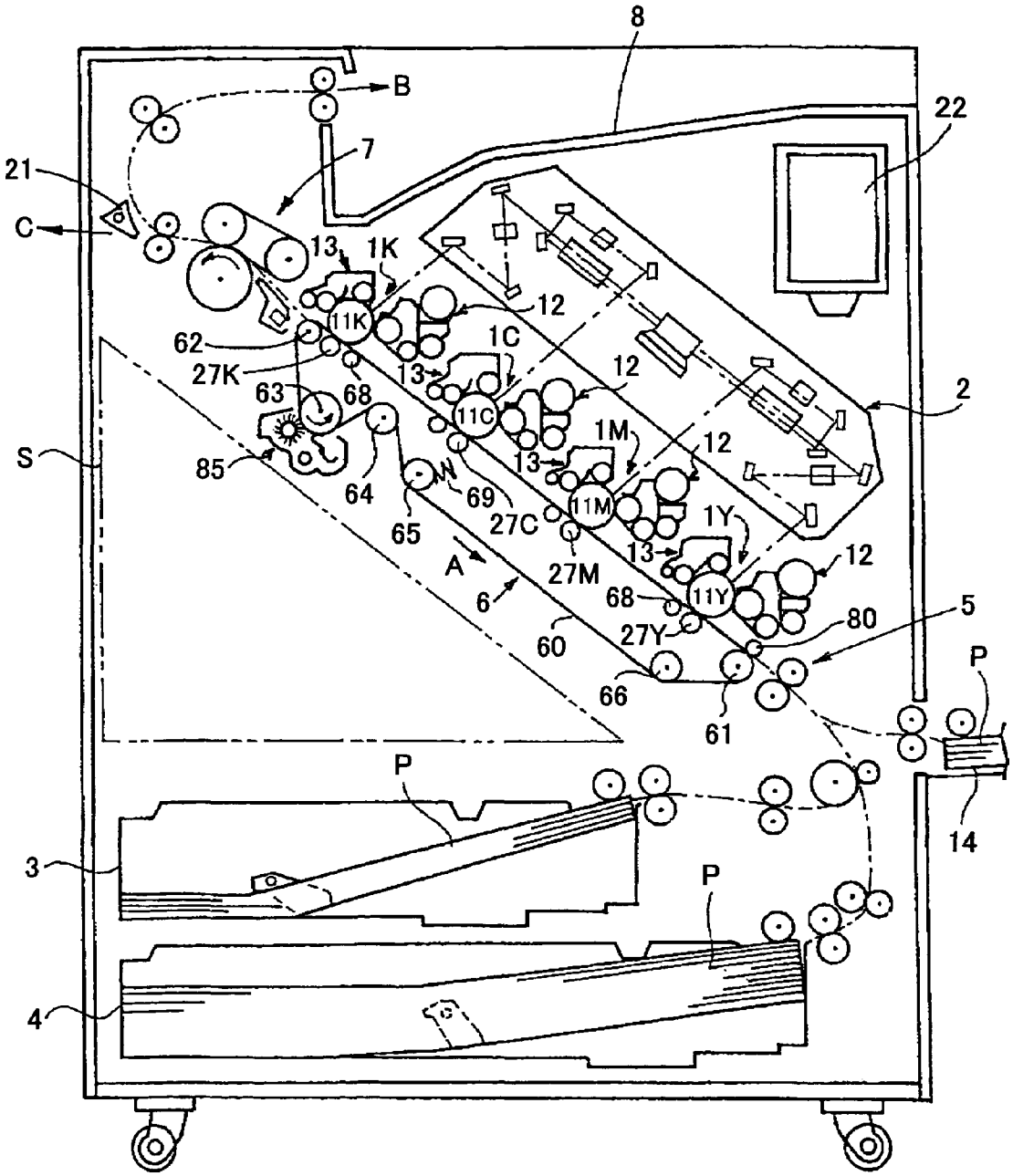
FIG. 6 is a schematic structural diagram of a laser printer of an example of an image forming apparatus having the belt driving control apparatus of the embodiment of the present invention.
Figure 7:
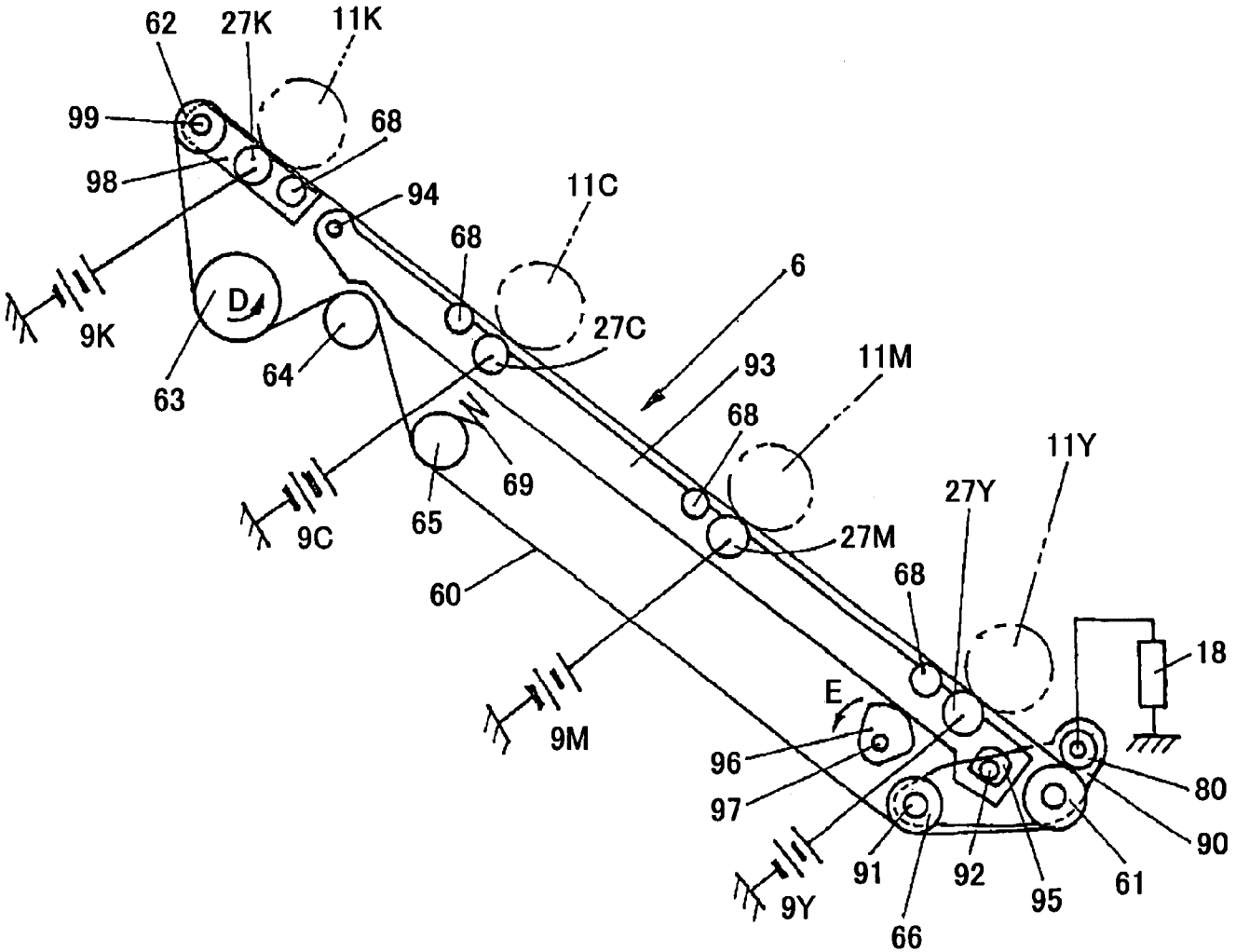
FIG. 7 is an expanded schematic diagram of a belt driving apparatus 6 shown in FIG. 6.

First, with reference to FIG. 6 and FIG. 7, a structural example of an image forming apparatus having a belt driving control apparatus of an embodiment of the present invention is discussed. A color laser printer (hereinafter "laser printer") forming a color image by using an electrophotographic method of a direct transferring method is an example of the image forming apparatus.

FIG. 6 is a schematic structural diagram of a laser printer of an example of an image forming apparatus having the belt driving control apparatus of the embodiment of the present invention.

In this laser printer, as shown in FIG. 6, four toner image forming parts 1Y, 1M, 1C and 1K are arranged in turn from an upstream side (right lower side in FIG. 6) in a direction which the transferring paper P is moved by moving the belt 60 along an arrow A. The toner image forming parts 1Y, 1M, 1C and 1K are configured to form images of yellow (Y), magenta (M), cyan (C) and black (K), respectively. Hereinafter, "Y" represents a member for yellow color, "M" represents a member for magenta color, "C" represents a member for cyan, and "K" represents a member for black color.

The toner image forming parts 1Y, 1M, 1C and 1K have respective photosensitive bodies 11Y, 11M, 11C, and 11K and developing units 12. In addition, the toner image forming parts 1Y, 1M, 1C and 1K are arranged so that rotational shafts of the photosensitive bodies are in parallel and the toner image forming parts 1Y, 1M, 1C and 1K are arranged with a designated pitch in a transferring paper moving direction.

The laser printer includes, in addition to the toner image forming parts 1Y, 1M, 1C and 1K, an optical writing unit 2, paper feed cassettes 3 and 4, a resist roller couple 5, a belt driving apparatus 6 having a transfer conveyance belt 60 configured to carry a transfer paper P and convey the transfer paper P so as to make the paper P pass a transferring position of the toner image forming parts, a belt fixing type fixing unit 7, a paper discharge tray 8, and others. The belt driving apparatus 6, together with a control system discussed below, puts the embodiment of the belt driving control apparatus of the present invention into practice, and functions as a transferring unit.

The laser printer further includes a manual feeding tray 14 and a toner refilling bottle 22. A waste toner bottle, a both-sides reversal unit, an electric power unit, and others are provided in a space S shown by a two-dotted broken line.

The optical writing unit 2 includes a light source, a polygon mirror, a f-θ lens, a reflection mirror, and others. Based on the image data, a laser light is irradiated on surfaces of the photosensitive drums 11Y, 11M, 11C and 11K while scanning.

FIG. 7 is an expanded view showing a schematic structural diagram of the belt driving apparatus 6 shown in FIG. 6.

The transferring conveyance belt 60 used in the belt driving apparatus 6 is a single layer endless belt having a high resistance and volume resistivity of $10^9$ through $10^{11}$ Ωcm. The transferring conveyance belt 60 is made of, for example, poly vinylidene fluoride (PVDF). The transferring conveyance belt 60 is wound around supporting rollers 61 through 66 so as to pass through transferring positions contacting and facing the photosensitive drums 11Y, 11M, 11C and 11K of the toner image forming parts.

An electrostatic attraction roller 80 is provided at an external circumferential surface side of the transferring conveyance belt 60 so as to face an entrance roller 61 positioned at an upstream side in the transferring paper moving direction. A designated voltage is applied to the electrostatic attraction roller 80 by electric power 18, so that the transferring paper 100 passing through the rollers 61 and 80 is charged and therefore is electrostatically adhered on the transferring conveyance belt 60. The roller 63 is a driving roller configured to friction-drive the transferring conveyance belt 60 and is rotated in a direction shown by an arrow D by a driving motor discussed below as a driving source.

Transferring bias applying members 27Y, 27M, 27C and 27K as transferring electrical field forming parts configured to form a transferring electrical field are provided at transferring positions facing the photosensitive drums so as to come in contact with a rear surface of the transferring conveyance belt 60. The transferring bias applying members 27Y, 27M, 27C and 27K are bias rollers where sponge or the like is provided at an external circumference. A transferring bias voltage is applied to the transferring bias applying members 27Y, 27M, 27C and 27K by roller core bars (not shown). A transferring electrical charge is provided to the transferring conveyance belt 60 by the applied transferring bias voltage, so that a transferring electrical field having a designated strength is formed at the transferring positions between the transferring conveyance belt 60 and the surface of the photosensitive drums 11. In addition, back up rollers 68 are provided so that contact of the transferring paper and the photosensitive bodies is properly maintained in an area where transferring is performed and good transferring nips are obtained.

The back up rollers 68 are provided at the transferring bias applying members 67Y, 67M and 67C and in the vicinity thereof. The back up rollers 68 are rotatably held in a body with a rocking bracket 93 which can be rotated with respect to a rotation shaft 94. The rocking bracket 93 is rotated clockwise by rotating a cam 96 fixed to a cam shaft 97 in a direction shown by an arrow E.

The entrance roller 61 and the electrostatic attraction roller 80 are supported in a body by the entrance roller bracket 90 and can be rotated with respect to the shaft 91 clockwise from a state shown in FIG. 7. A pin 92 projecting from the entrance roller bracket 90 is inserted into a hole forming part 95 provided in the rocking bracket 93, so that the entrance roller bracket 90 is rotated together with the rotation of the rocking bracket 93. By the clockwise rotation of the brackets 90 and 93, the back up rollers 68 provided at the bias applying members 27Y, 27M and 27C and in the vicinity thereof are separated from the photosensitive bodies 11Y, 11M and 11C, respectively, so that the entrance roller 61 and the electrostatic attraction roller 80 go down. Under this structure, when the image is formed by only black toner, it is possible to avoid the contact of the transferring conveyance belt 60 with the photosensitive bodies 11Y, 11M and 11C.

On the other hand, the transferring bias applying member 27K and the back up roller 68 neighboring to the transferring bias applying member 27K are rotatably supported by an exit bracket 98 and can be rotated with respect to the shaft 99 which is coaxial with the exit roller 62. When the belt driving apparatus 6 is detached from the laser printer main body, by the operation of a stealing (not shown), the exit bracket 98 can be rotated clockwise so that the transferring conveyance belt 60 together with the transferring bias applying member 27K and nearby back up roller 68 can be separated from the photosensitive body 11 for forming a back image.

As shown in FIG. 6, a cleaning apparatus formed by a brush roller and a cleaning blade is arranged on the external circumferential surface of a part of the transferring conveyance belt 60 wound around the driving roller 63 so as to come in contact with each other. A foreign body such as residual toner adhered on the transferring conveyance belt 60 is removed by the cleaning apparatus 85.

A roller 64 is provided at a downstream side of the driving roller 63 in the moving direction of the transferring conveyance belt 60 so as to push against the external circumferential surface of the conveyance belt 60. As a result of this, a large winding angle of the transferring conveyance belt 60 against the driving roller 63 can be maintained. A tension roller is provided at a downstream side of the roller 64. The tension roller 65 comes in contact with the internal circumferential surface of the transferring conveyance belt 60 and pushes the belt 60 to the outside by the force of a spring 69 as a pressing member, so as to give tension to the transferring conveyance belt 60.

Next, an image forming operation by the laser printer is discussed.

At the time of image forming by the laser printer, the transferring paper P is fed from one of the paper feeding cassettes 3 and 4 or the manual feeding tray 14 shown in FIG. 6 and conveyed by the conveyance rollers along a conveyance path shown by a dotted line in FIG. 6 by being guided by the conveyance guide (not shown), so as to be sent to a stopping position where the resist roller couple 5 is provided.

On the other hand, at the time when the color image is formed, the photosensitive drums 11Y, 11M, 11C and 11K of the four toner image forming parts 1Y, 1M, 1C and 1K are rotated clockwise in FIG. 6. After the surfaces of the photosensitive drums 11Y, 11M, 11C and 11K are electrically charged by charging members not shown in FIG. 6, laser light modulated by data of the colors of the image to be formed is irradiated and scanned on the surfaces of the photosensitive drums 11Y, 11M, 11C and 11K by the optical writing unit 2, so that electrostatic latent images are written. After that, the images are developed by the toner of the colors by the developing unit so that the toner images of respective colors are formed on the surfaces of the photosensitive drums 11Y, 11M, 11C and 11K.

As discussed above, the transferring paper P stopped for a time by being held by the resist roller couple 5 is sent out by the resist roller couple 5 at a designated timing. The transferring paper P is carried by the transferring conveyance belt 60 and sent to the toner image forming parts 1Y, 1M, 1C and 1K in turn so as to pass through the transferring nips. The toner images of respective colors formed on the photosensitive drums 11Y, 11M, 11C and 11K of the toner image forming parts 1Y, 1M and 1C are formed where image forming timing is staggered so that the toner images are stacked on the transferring paper P in the transferring nips. When the transferring paper P passes through the transferring nips, the toner images are transferred on the transferring paper P by the action of the nip pressure or the transferring electrical field.

The surfaces of the photosensitive bodies 11Y, 11M, 11C and 11K after the toner image is transferred are cleaned by the cleaning apparatus 13 and static is eliminated so as to prepare for the next forming of an electrostatic latent image.

On the other hand, after a full color toner image is formed and fixed to the transferring paper P, the transferring paper P goes in a first paper discharge direction B or a second paper discharge direction C as corresponding to the rotational position of a switching guide 21. In a case where the transferring papers P are discharged on the paper discharge tray 8 in the first paper discharge direction B, the transferring papers P are stacked face down so that an imaged surface faces down. On the other hand, in a case where the transferring paper P is discharged in the second paper discharge direction C, the transferring paper P is conveyed toward a post-treatment apparatus not shown such as a sorter or a binding apparatus or conveyed to the resist roller couple 5 again for both-sides printing via the switch back part.

Thus, the laser printer forms a full color image on the transferring paper P.

In such a tandem type image forming apparatus, it is important from the perspective of prevention of generation of color registrations to stack the toner images with high positional precision. However, in the driving roller 63, the entrance roller 61, the exit roller 99 and the transferring conveyance belt 60 used in the belt driving apparatus 6, a manufacturing error of several tens am is generated at the time of manufacturing parts. The error causes a variation element generated when the parts are rotated to be transferred to the transferring conveyance belt 60 so that variation of the conveyance speed of the transferring paper is generated.

By the variation of the transferring speed of the transferring paper, a gap of the timing at which the toner images on the photosensitive drums 11Y, 11M, 11C and 11K are transferred to the transferring paper P is generated so that a color registration in the sub scanning direction, namely a conveyance direction of the transferring paper, is generated. Especially, in an apparatus configured to form an image by minute dots such as 1200×1200 DPI, a timing gap of several μm is found as the color registration. Because of this, in the driving control apparatus of this embodiment, the rotational speed of a right lower roller 66 provided at a right lower part in FIG. 7 is detected by a detection signal of an encoder provided on a shaft of the right lower roller 66. The transferring conveyance belt 60 is run at a constant speed by feed-back controlling the rotation of the driving roller 63.

Figure 8:
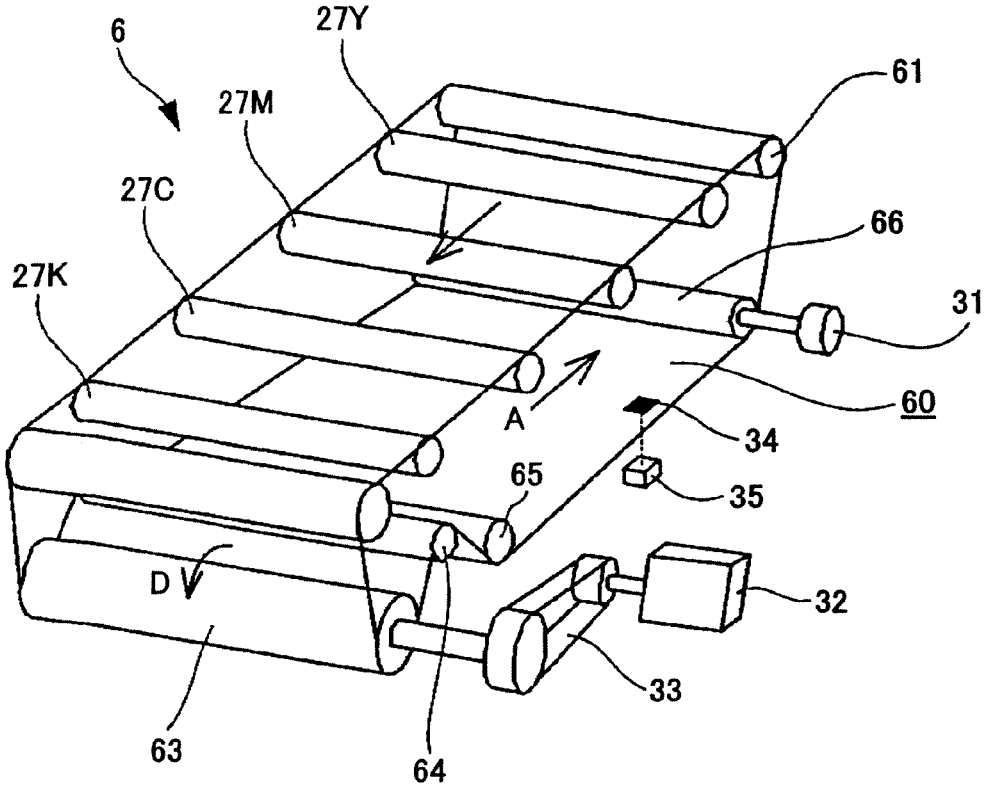
FIG. 8 is a perspective view of the belt driving apparatus 6 shown in FIG. 6.

FIG. 8 is a perspective diagram of the belt driving apparatus 6 shown in FIG. 6.

Referring to FIG. 8, the transferring driving roller 63 is connected to the driving motor 32 via the timing belt 33. The transferring driving roller 63 is rotated proportional to the rotational speed of the driving motor 32. By the rotation of the transferring driving roller 63, the transferring conveyance belt 60 is friction-driven so that the right lower roller 66 is also friction-driven. As discussed above, in this embodiment, the encoder 31 is provided on the shaft of the right lower roller 66. The speed of the driving motor 32 is controlled based on the rotational speed of the right lower roller 66 detected by the encoder 31.

Figure 9:
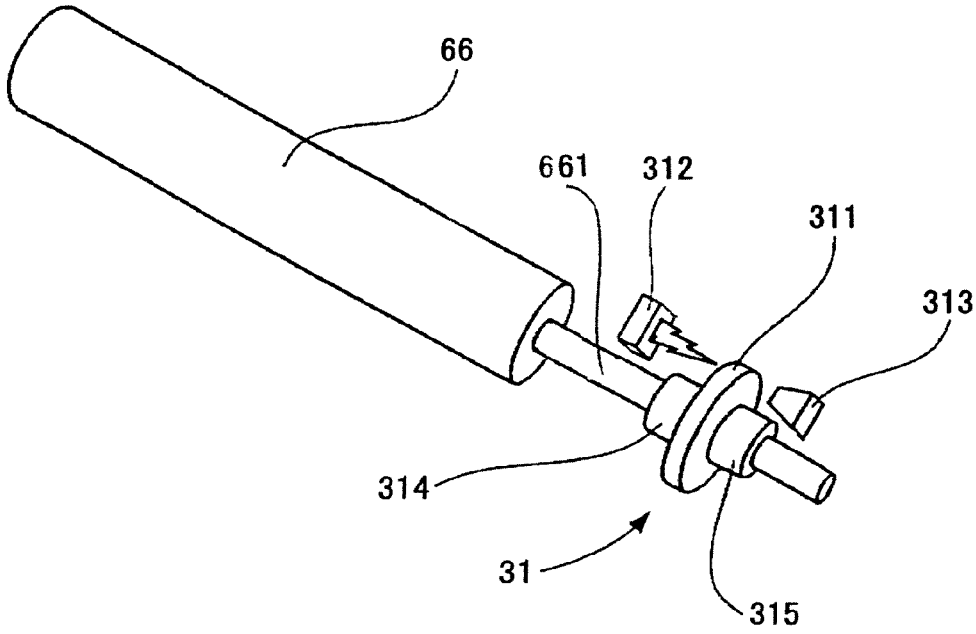
FIG. 9 is a perspective view of details of a right lower roller 66 and an encoder 31.

FIG. 9 is a perspective view of details of the right lower roller 66 and the encoder 31. The encoder 31 includes a disk 311, a light emitting element 312, a light receiving element 313, and press-fitting bushings 314 and 315. The disk 311 is fixed by press fitting the press-fitting bushings 314 and 315 onto a shaft 661 of the right lower roller 66 so as to rotate with the rotation of the right lower roller 66.

In addition, a radial-shaped slit is formed in the disk 311 in a circumferential direction so that light permeates the slit (not shown) with resolution of several hundreds unit. The light emitting element 312 and the light receiving element 313 are arranged at opposite sides of the slit. The number of pulse signals corresponding to the rotation angle of the right lower roller 66 is generated by the light receiving element 313. A moving angle (hereinafter "angle variation") of the right lower roller 66 is detected by using the pulse signal so that a driving amount of the driving motor 32 is controlled.

As shown in FIG. 8, a mark (hereinafter "belt mark") 34 is provided in a non-image forming area of a surface of the transferring conveyance belt 60 so that a standard position of the transferring conveyance belt 60 is established. A mark sensor 35 as mark detection means is provided at a position facing a passing path of the mark 34. The passing timing of the mark is detected by the mark sensor 35. This is done because, as discussed below, a position of the detection angular displacement error generated by the variation of the belt thickness is made to correspond to the belt position when the feed back control of the above-mentioned driving roller 63 is done.

Figure 1:
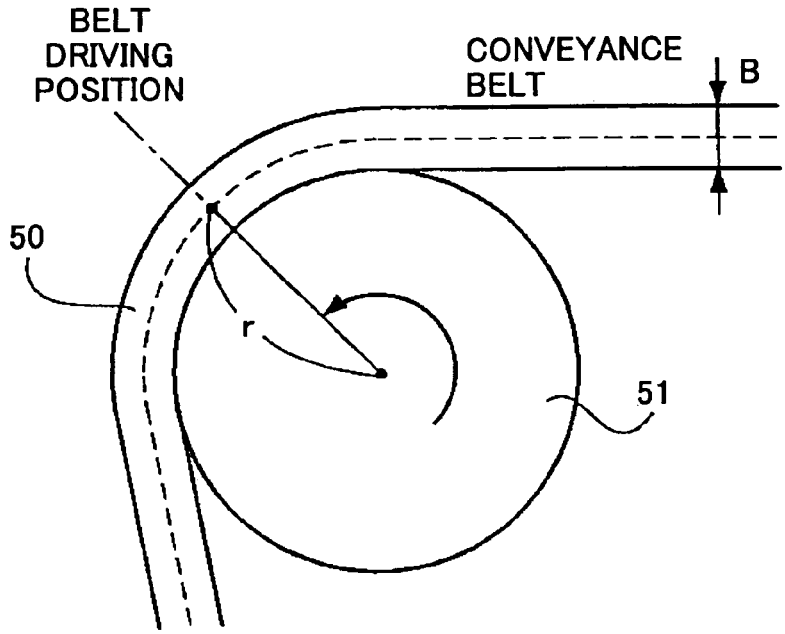
FIG. 1 is a view showing a relationship between a belt thickness B of the conveyance belt and a belt driving effective radius r for explaining problems of the related art.
Figure 2:
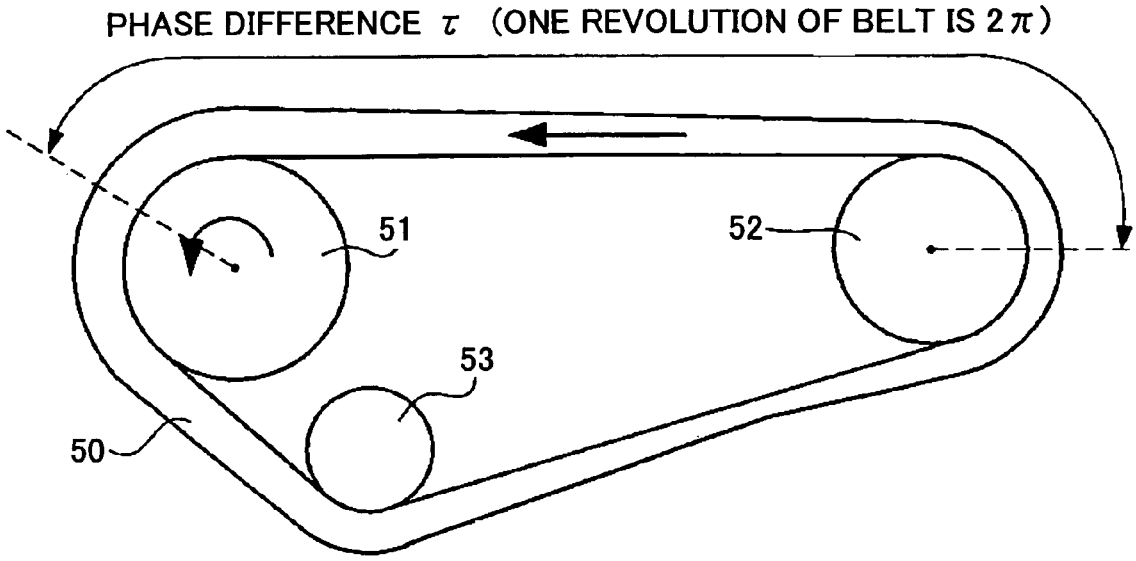
FIG. 2 is a view showing a model of a driving conveyance system of the conveyance belt.
Figure 3:
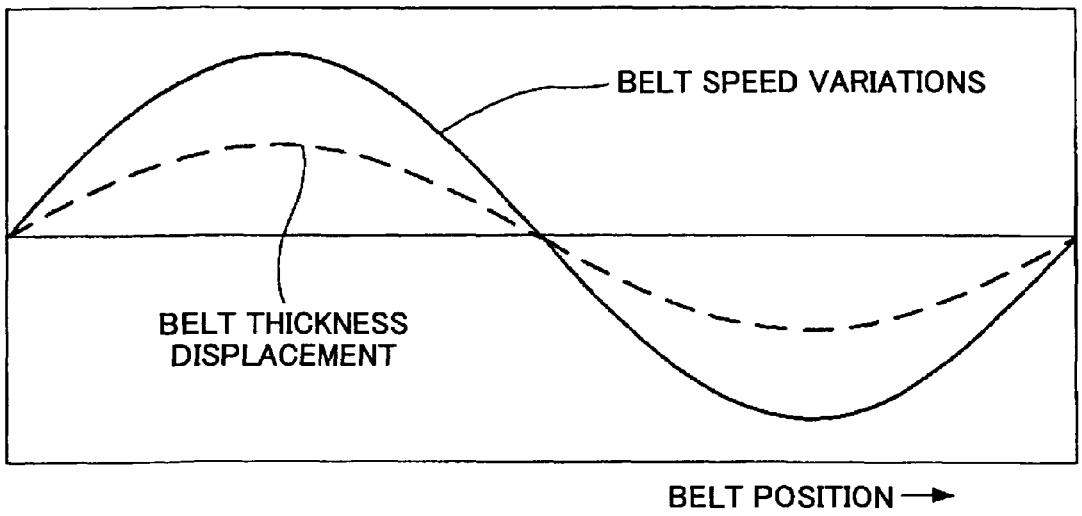
FIG. 3 is a graph showing a belt thickness displacement and a belt speed variation in a single revolution of the conveyance belt in a case where the driving roller is rotated at a certain angular speed.
Figure 10:
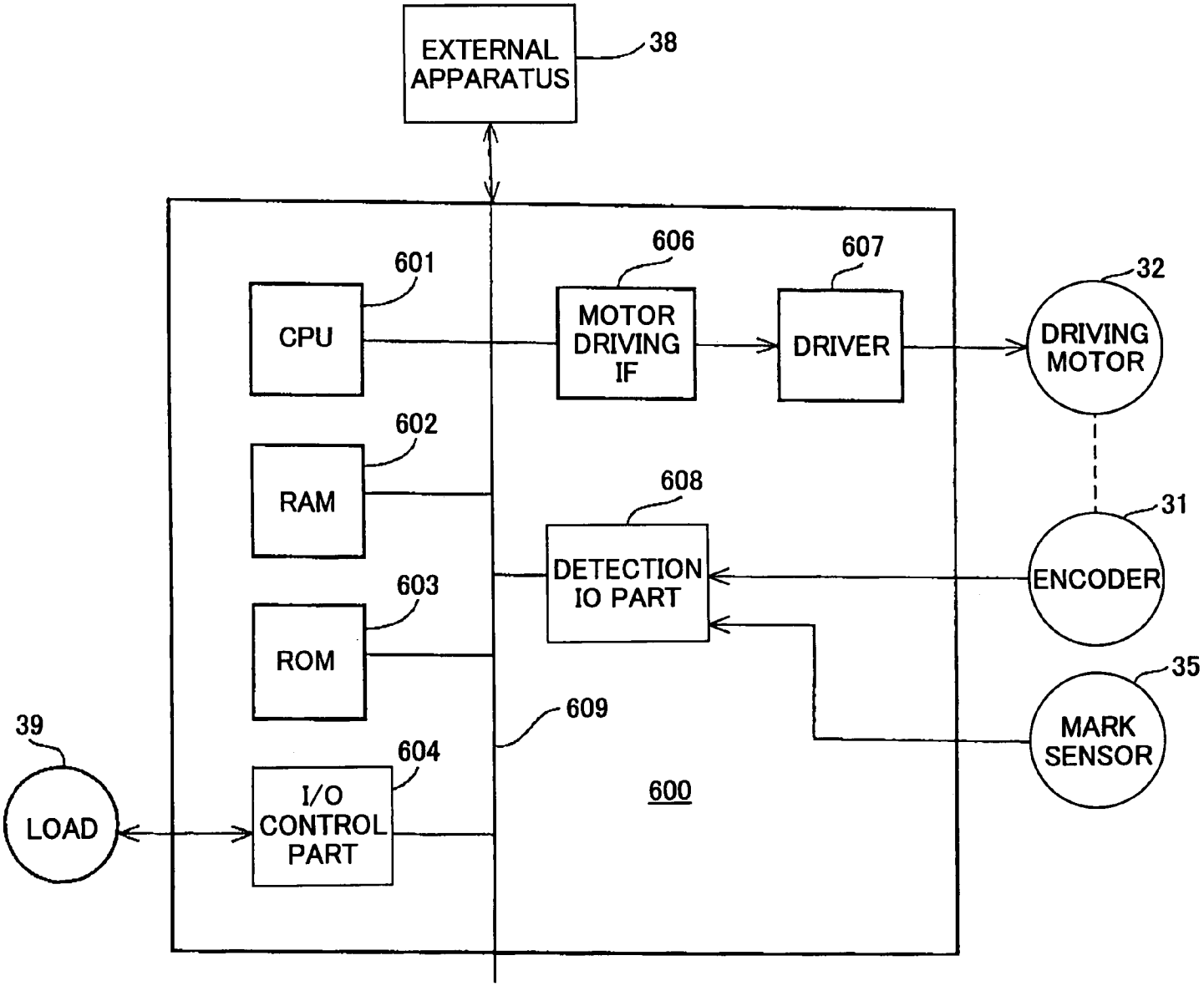
FIG. 10 is a block diagram showing a hardware structure of a driving motor control system of the belt driving control apparatus of the laser printer shown in FIG. 2 and a subject of the control.

FIG. 10 is a block diagram showing a hardware structure of a driving motor control system of the belt driving control apparatus of the laser printer shown in FIG. 2 and a subject of the control.

In a control system (control part) 600, a driving pulse of the driving motor 32 is digitally controlled based on an output signal of the above-mentioned encoder 31. The control system 600 includes a CPU 601, a RAM 602, a ROM 603, an IO control part 604, a motor driving I/F part 606, a driver 607, a detection IO part 608 and a bus 609.

The CPU 601 performs control of the entire laser printer including control of receipt of image data being input from an external apparatus 38 and receipt and transferring of a control command. The RAM 602 used as a work memory of the CPU 601, the ROM 603 used as a memory where a program is stored, and the IO control part 604 are connected via the bus. Based on an instruction of the CPU 601, a read and write process of the data and various operations of the motor driving the load 39, a sensor, a clutch solenoid, and others are performed.

Based on the driving instruction from the CPU 601, a motor driving IF 606 outputs an instruction signal setting a driving frequency of a driving pulse signal to the driving motor 32 configured to drive the transferring conveyance belt 60 via the driver 607. Since the driving motor 32 is rotated based on this frequency, it is possible to perform variable control of the conveyance speed of the transferring conveyance belt 60.

An output signal of the encoder 31 is input to the detection IO part 608. The detection IO part 608 processes the output pulse of the encoder 31 so as to convert the pulse into a digital numerical value. The detection IO part 608 includes a counter configured to count the output pulse of the encoder 31. The counter multiplies the counted numerical value by a conversion constant of a predetermined pulse number for diagonal displacement so as to covert the counted numerical values into a digital numerical value corresponding to an angular displacement of the shaft 661 (See FIG. 9) of the right lower roller 66. A signal of the digital numerical value corresponding to an angular displacement of the disk 311 of the encoder 31 is sent to the CPU 601 via the bus 609.

The motor driving IF part 606 generates a pulse shaped control signal giving a driving frequency sent from the CPU 601 based on the setting of the driving frequency.

The driver 607 includes a power semiconductor element such as a transistor. The driver 607 operates based on a pulse shaped control signal output from the motor driving IF part 606 so as to apply the pulse shape driving voltage to the driving motor 32. As a result of this, the driving motor 32 is drive-controlled at a speed proportional to a designated driving frequency output from the CPU 601. As a result of this, variable value control is performed so that the angular displacement of the disk 311 of the encoder 31 becomes an object angular displacement, and the right lower roller 66 is rotated at a uniform angular speed. The angular displacement of the disk 311 is detected by the encoder 31 and the detection IO part 608 and taken into the CPU 601, so that the control is repeated.

In addition to the RAM 602 being used as a work area when the program stored in the ROM 603 is implemented, detection of angular displacement error data of the one revolution of the conveyance transferring belt 60 from the mark sensor 35, corresponding to the thickness variation of the transferring conveyance belt 60 measured in advance, is stored. Since the RAM 602 is a volatile memory, a phase or amplitude parameter of the transferring conveyance belt 60 as shown in FIG. 11 is stored in a non-volatile memory such as an EEPROM not shown in FIG. 11, and data of the one revolution of the belt 60 is expanded in the RAM 602 by using a SIN function or an approximation formula at the time when the electric power is turned on or the driving motor 32 is turned on.

Figure 11:
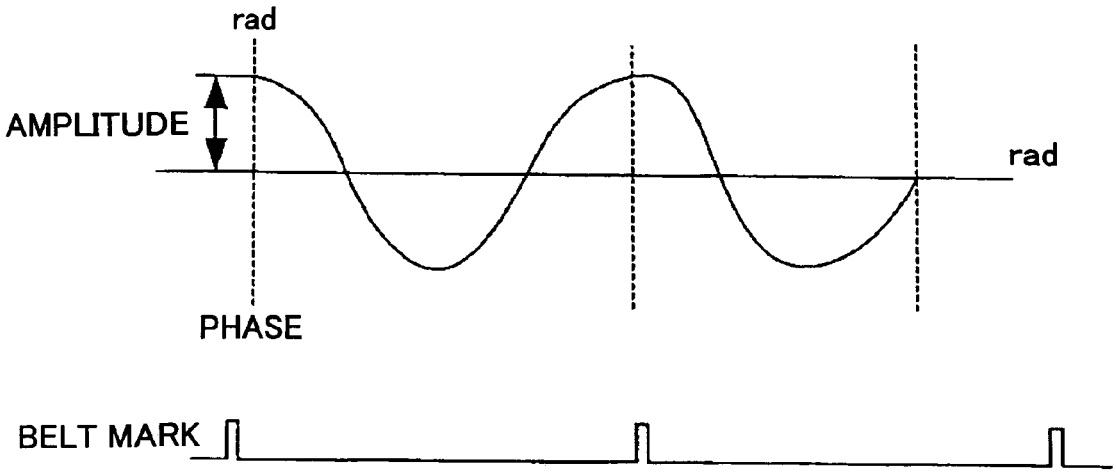
FIG. 11 is a graph showing a relationship between phase and amplitude parameters of a transferring conveyance belt and a belt mark.

FIG. 11 also shows the detection pulse of the belt mark detected every one revolution of the transferring conveyance belt 60 by the mark sensor 35.

In the meantime, generally, in proportional control computing used in such feed back control, the driving speed of the driving motor is controlled by applying a control gain to the difference between the detected angular displacement and the object angular displacement every control cycle. Therefore, if the angular displacement error due to the belt thickness is large, the driving motor is driven in a further amplified state. Because of this, the speed variation of the transferring belt is generated due to the amount of the belt thickness so that the color registration is generated.

As discussed above, if a thick part of the belt 60 is in contact with the idler roller 66 even if the driving motor 32 is driven at a constant speed and the transferring conveyance belt 60 is conveyed without speed variation, a dependent effective radius of the belt is increased so that the amount of the angular displacement of the idler roller 66 per a constant time is decreased. This is detected as a reduction of the belt conveyance speed. In addition, if a thin part of the belt 60 is in contact with the idler roller 66, the amount of the angular displacement of the idler roller 66 is increased and this is detected as an increase of the belt 60 conveyance speed.

Figure 12:
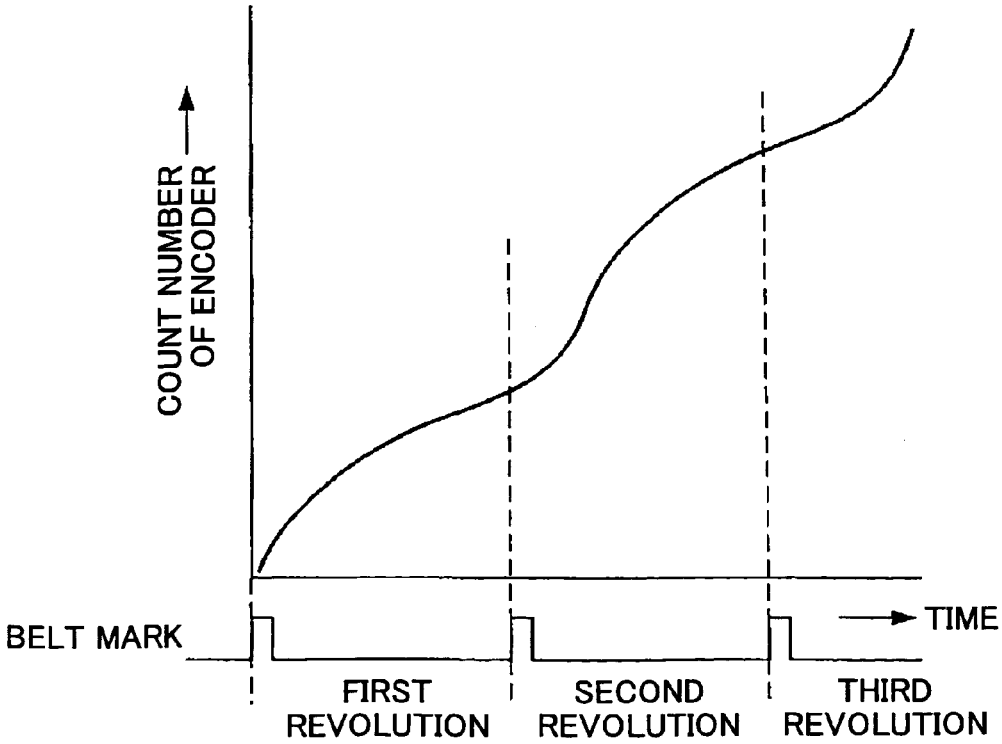
FIG. 12 is a graph showing an example of a result obtained by sampling a count value of an output pulse of an encoder 31 shown in FIG. 8 at a certain timing.

The above-discussed explanation is regarding behavior when the driving motor 32 is driven at a constant speed. In other words, in a case where the variation of the belt thickness is regarded as a sine wave shaped wherein one revolution of the belt is a cycle, if the result obtained by sampling the count value of the output pulse of the encoder 31 at a constant timing is as shown in FIG. 12, the right lower roller 66 is rotated at a constant speed. Because of this, in this embodiment of the present invention, an object angular displacement every control cycle is generated like a curve shown in FIG. 12 and the driving motor 32 is controlled as the encoder is rotated like this object angular displacement, so that the speed of the transferring conveyance belt 60 is made constant.

This means that an actual thickness in units of μm of a transferring conveyance belt is not measured so as not to used as a control parameter. Rather, an angular displacement error in units of radians of an encoder generated due to an influence of the belt thickness is used as a control parameter.

As discussed above, since a control parameter is generated from an output result of the encoder 31 when the driving motor 32 is driven at a constant speed, the control parameter can be generated by an existing actual machine. Since a measuring apparatus is not necessary for measuring the thickness of the belt, it is possible to perform control at a very low cost.

In addition, as discussed below, in most cases, the thickness of the transferring conveyance belt has a sine wave shaped property. Accordingly, in a case where high resolution measurement can be done by an outside jig, a phase and a maximum amplitude at the belt mark are calculated from the measurement result by the outside jig. The driving control can be realized by inputting the phase and the maximum amplitude as control parameters via an operation panel. As the output result of the actual encoder 31, not only the detected angular displacement error due to the thickness variation of the belt but also variations of the driving roller or other elements or rotational off-centering elements, are combined and output. Because of this, only influencing element of the idler roller are extracted and the extracted result is used as a control parameter of the detection angular variation error.

Figure 5:
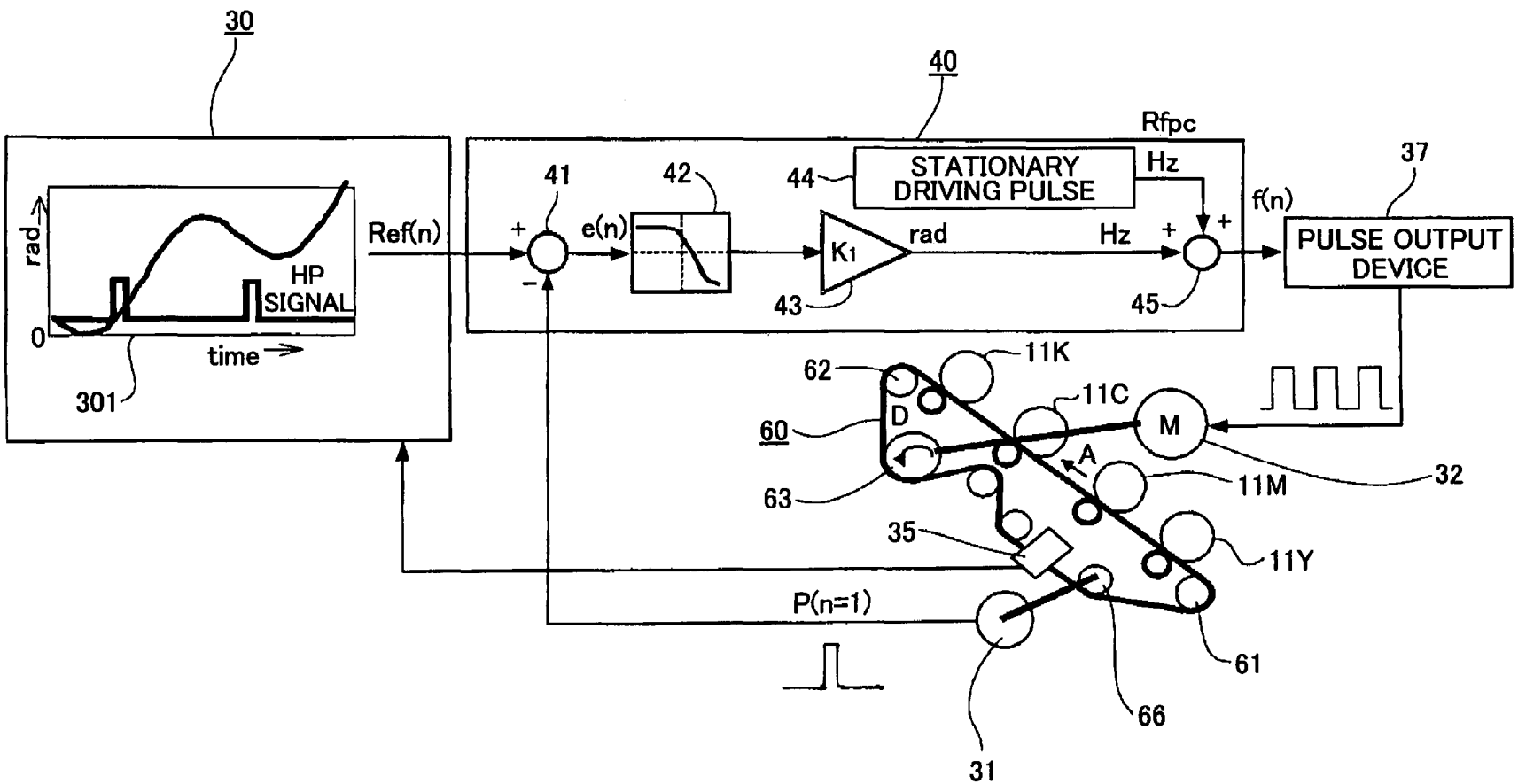
FIG. 5 is a schematic functional block diagram showing functions of a belt driving control apparatus of an embodiment of the present invention.

FIG. 5 is a schematic functional block diagram showing functions of a belt driving control apparatus of an embodiment of the present invention. FIG. 5 shows an example where the present invention is applied to the above-mentioned belt driving apparatus 6.

As shown in FIG. 5, a controller 40 includes a subtracting circuit 41, a low-pass filter 42 configured to eliminate high frequency noise, a proportional computing part (gain Kp) 43, a stationary driving pulse frequency setting part 44, and adding circuit 45.

The object angular displacement generation part 30 includes a memory 301. The memory 301 stores data of an object angular displacement that is a control target value obtained by adding an error of angular displacement generated by the thickness variations of the transferring conveyance belt 60 measured in advance.

A mark detection signal detected at a home position (HP) every one revolution of the transferring conveyance belt 60 by the mark sensor 35 is input and the object angular displacement Ref(n) is read from the memory 301 in turn as corresponding to the time that has passed and input to the controller 40.

In the controller 40, the object angular displacement Ref(n) that is a control target value input from the object angular displacement generation part 30 and the detected angular displacement P(n-1) from the encoder 31 are input to the subtracting circuit 41 so that the difference e(n) is calculated. In other words, computing of a displacement amount of the difference is performed. The difference e(n) is proportionally amplified by the gain Kp by using the proportional computing part 43 and an amount of correction (rad) is provided to the adding circuit 45 from the proportional computing part 43. In the adding circuit 45, the amount of correction (rad) is added from the proportional computing part 43 to a constant stationary driving pulse (Refpc) Hz from the stationary driving pulse frequency setting part 44 so that the driving pulse frequency f(n) is determined and output to a pulse output device 37.

Thus, adding of an angular displacement error generated by the thickness variations of the transferring conveyance belt 60 is periodically repeated as corresponding to the timing of the output of the mark sensor 35 detected by the rotation of the conveyance transferring belt 60.

Next, a method for obtaining the detection angular displacement error data of the encoder of one revolution of the belt 60 generated by the thickness variations of the belt 60 which data are necessary for computing the amplitude parameter or the phase of the belt is discussed.

Figure 4:
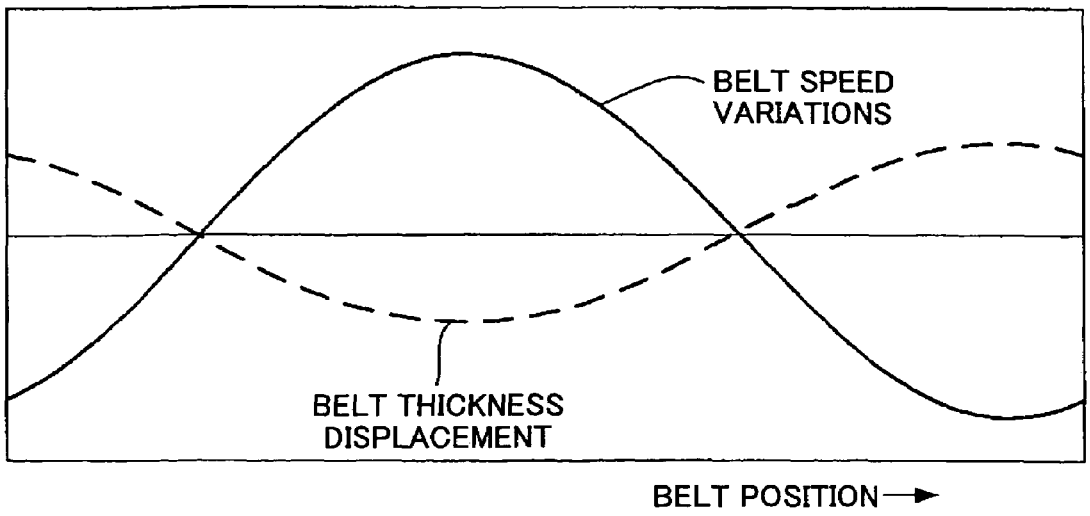
FIG. 4 is a graph showing a belt thickness displacement and a belt speed variation at an idler roller when the conveyance belt is conveyed at a certain speed.

First, a heat source of a fixing heater which may cause a speed change of the belt driving apparatus is turned off and the driving motor 32 is driven at a constant speed. The driving motor 32 is run under a no-load condition until the driving of the transferring conveyance belt 60 is stable. After the completion of the no-load running, the count value of the pulses generated by the encoder 31 is sampled at a constant timing "D+Y1" times (wherein "D" is the number of data samples until the driving roller 63 is driven twice) until a mark (hereinafter "belt mark") shown in FIG. 4 is detected by the mark sensor 35; the difference e(n) between object angular displacement Ref(n) of the encoder 31 and the detected angular displacement P(n-1) of the encoder 31 is computed (4W+2D+Y1+Y2) times.

Figure 13:
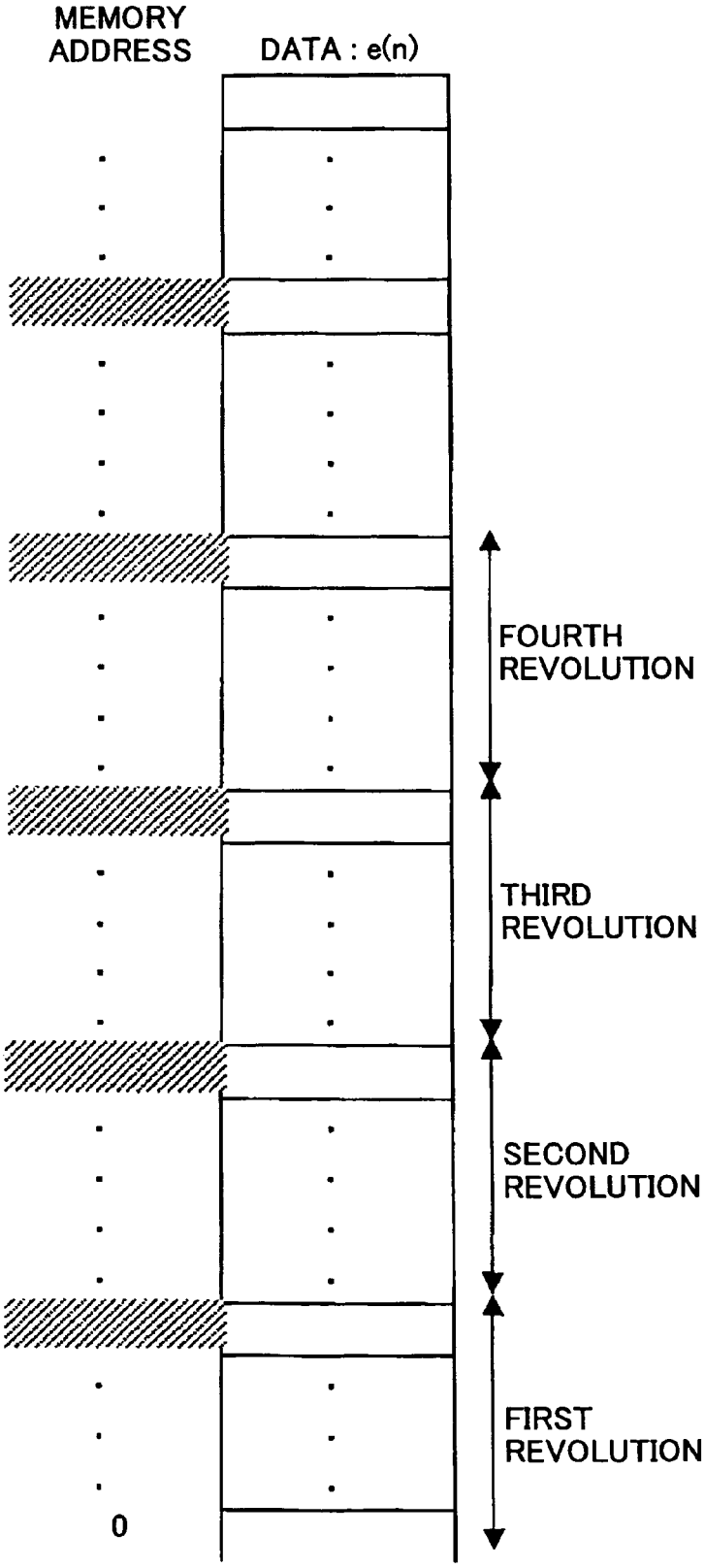
FIG. 13 is a memory map in a state after (n) is stored.

Here, W is the number of data samples per one revolution of the belt and is determined by available capacity of the RAM 602. As the available capacity of the RAM 602 is larger, W is set to have a large value. Furthermore, Y1 and Y2 are samplings for spare. In a case where the sampling is done at a constant timing, due to variation with time of the driving system, the number of data samples per one revolution of the belt may not be W or the number of data samples during a time period in which the driving roller 63 is rotated twice. Hence, space for sampling is necessary. The calculated e(n) is stored in turn from the address "0" of the RAM 602. The first memory address when e(n) is stored first after the belt mark is detected is Z1. The second memory address when e(n) is stored first after the belt mark is detected is Z2. The fifth memory address when e(n) is stored first after the belt mark is detected is Z5. A memory map after e(n) is stored is shown in FIG. 13.

Figure 16:
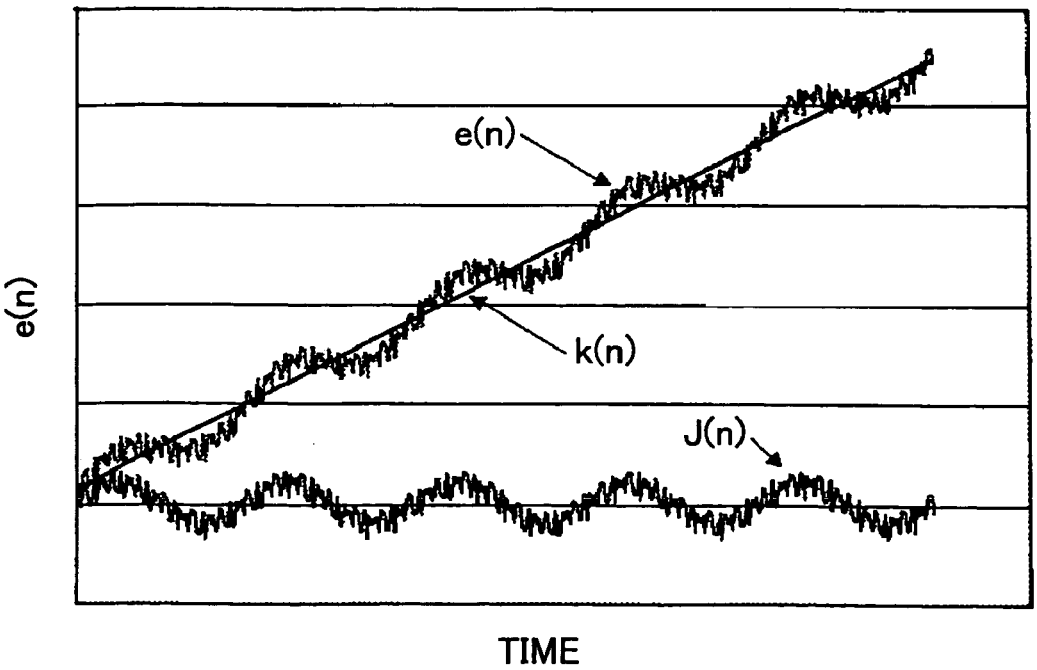
FIG. 16 is a graph showing e(n) that is a difference between an object angular displacement Ref(n) and a detection angular displacement P(n-1) of an encoder and showing J(n) obtained by eliminating an inclination from e(n)

In the measurement of the angular displacement error, the driving motor 302 is driven at a constant speed without position control. Hence, e(n) that is the difference between object angular displacement Ref(n) of the encoder 31 and the detected angular displacement P(n-1) of the encoder 31 may have an inclination as shown in FIG. 16. In addition, a noise element other than the angular displacement error of the encoder 31 generated by the thickness variation of the transferring conveyance belt is included.

Next, the inclination element of e(n) is eliminated. By a least squares method, an inclination element k(n) of e(n) as shown in FIG. 12 is calculated. Then, J(n)=e(n)−k(n) obtained by eliminating k(n) from e(n) is calculated so that J(n) is stored in turn from the address "0" of the RAM 602.

Next, the angular displacement error generated at a cycle other than one cycle of the transferring conveyance belt 60 is eliminated by a moving average process. In this embodiment, in order to selectively eliminate the angular displacement error due to off-centering of the driving roller 63 which friction-conveys the transferring conveyance belt 60, the moving average process is implemented by using the number of data samples for a time during which the driving roller 63 is rotated twice. In a case where the number of data sampled for a time during which the driving roller 63 is rotated twice is D, the moving average process is implemented by the following computing formula.

J'(0)={[Z1−D]+ . . . +[Z1−1]+[Z1]+[Z1+1]+ . . . +[Z1+D]}/(2D+1) is calculated and J'(0) is stored in the address "0" of RAM 602.

J'(1)=J'(0)+{[Z1+D−1]−[Z1−D]}/(2D+1) is calculated and J'(1) is stored in the address "1" of RAM 602.

J'(2)=J'(1)+{[Z1+D+2]−[Z1−D+1]}/(2D+1) is calculated and J'(2) is stored in the address "2" of RAM 602.

J'(3)=J'(2)+{[Z1+D+3]−[Z1−D+2]}/(2D+1) is calculated and J'(3) is stored in the address "3" of RAM 602.

The above-mentioned calculation is done until "J'(Z5-Z1) is stored in the address of "Z5-Z1" of the RAM 602.

In the above-mentioned formulas, "[ ]" is a value stored in the memory address of the RAM 602 mentioned in "[]".

Figure 14:
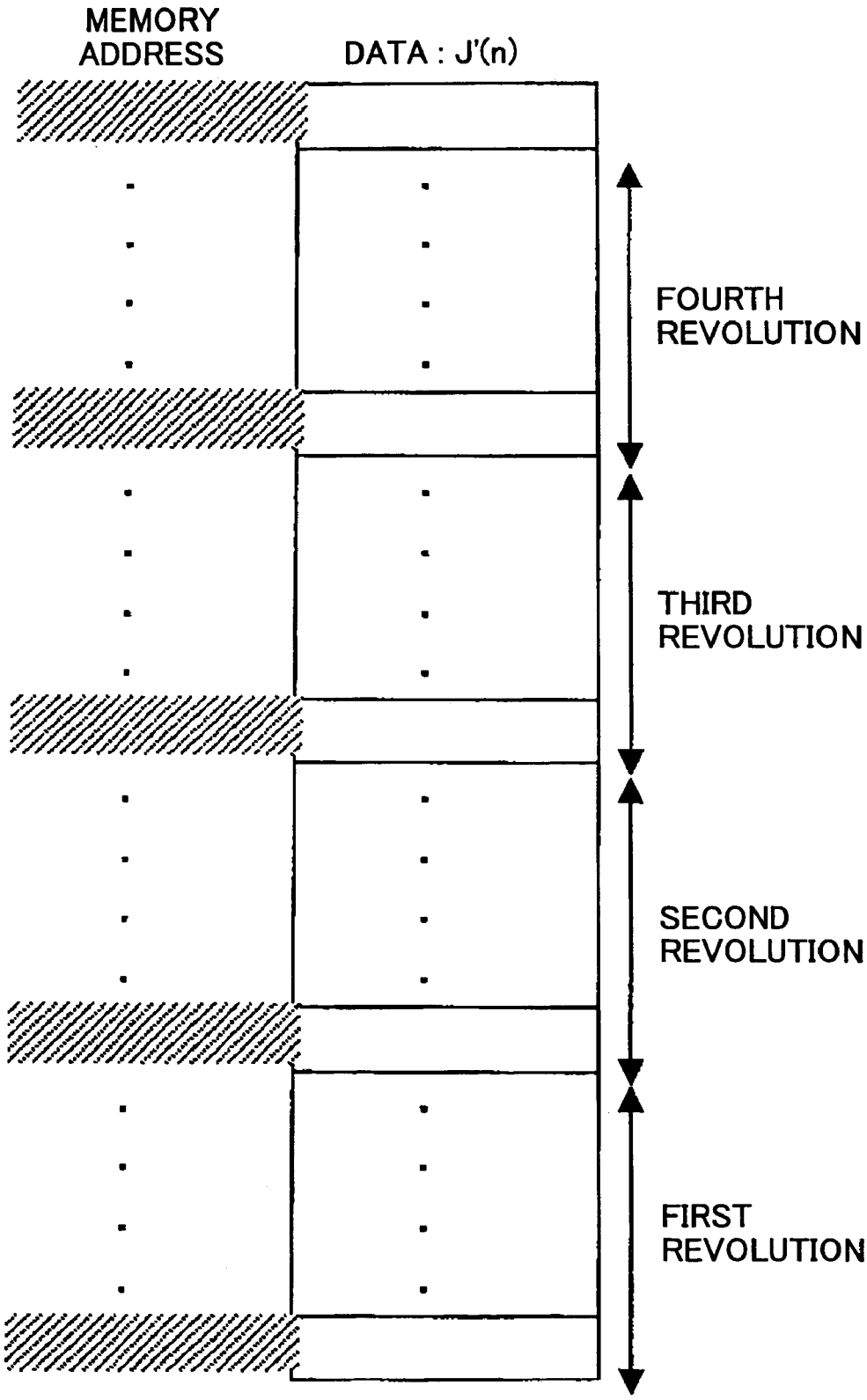
FIG. 14 is a memory map showing a state where J'(n) is stored after a moving average process.

A memory map where J'(n) after the moving average process is stored is shown in FIG. 14. Data shown in FIG. 17 wherein the angular displacement error generated in a cycle other than the belt 60 one cycle is obtained.

Next, a circuit average process of the belt rotation cycle is performed in order to eliminate random noise and emphasis of the detected angular displacement error of the encoder 31 generated by the thickness variations of the transferring conveyance belt 60. In this embodiment, the circle average process is done by data of four circles (revolutions) of the belt. First, the number of actual data samples in each circle from the first circle to fourth circle are compared with each other and a least number of the data samples is determined as W' and the following calculations are done so that the circle average process is performed.

J"(0)={[0]+[Z2-Z1]+[Z3-Z1]+[Z4-Z1]}4 is calculated and J"(0) is stored in the address "0" of RAM 602.

J"(1)={[1]+[Z2-Z1+1]+[Z3-Z1+1]+[Z4-Z1+1]}/4 is calculated and J"(1) is stored in the address "1" of RAM 602.

J"(2)={[2]+[Z2-Z1+2]+[Z3-Z1+2]+[Z4-Z1+2]}/4 is calculated and J"(2) is stored in the address "2" of RAM 602.

J"(W'-1)={[W'-1]+[Z2-Z1+W'-1]+[Z3-Z1+W'-1]+[Z4-Z1+W'-1]}/4 is calculated and J"(W'-1) is stored in the address "W'-1" of RAM 602.

In the above-mentioned formulas, "[ ]" is a value stored in the memory address of the RAM 602 mentioned in "[]".

Figure 15:
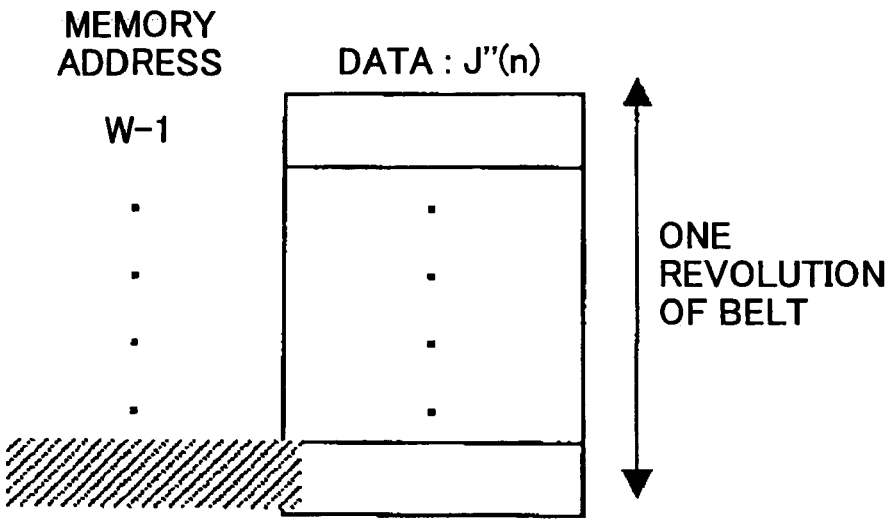
FIG. 15 is a memory map showing a state where J"(n) is stored after a circumference average process.

A memory map where J"(n) after the moving average process is stored is shown in FIG. 15.

Figure 17:
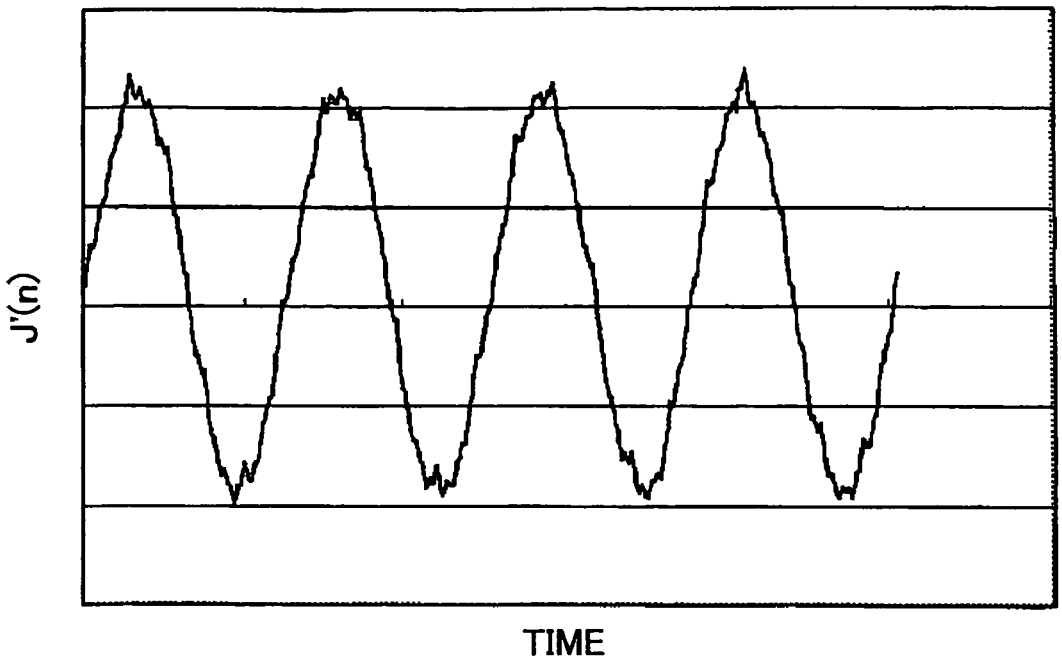
FIG. 17 is a graph showing data where a detection angular displacement error generated at a cycle other than a single belt revolution is eliminated.
Figure 18:
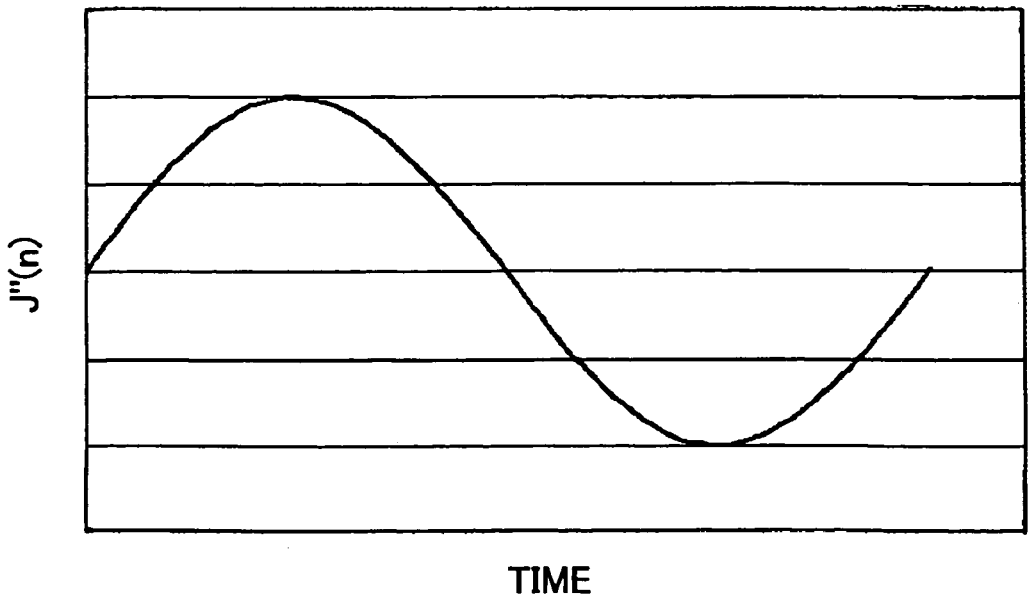
FIG. 18 is a graph showing an example of detection angular displacement error data of the encoder of a single belt revolution generated by a change of a thickness of the transferring belt.

Data shown in FIG. 17 are angular displacement error data of the encoder 31 of the belt one cycle generated by the thickness variations of the transferring conveyance belt. An amplified parameter and phase of the belt are calculated by the data.

In a case where the calculated values of the amplified parameter and phase of the belt are not in the preset range, the situation is determined as an error. In this case, the calculated result of the circle average is stopped being stored in the non-volatile memory, the values of the amplified parameter and phase of the belt are set to be "0", and error history information is stored in a volatile memory such as an EEPROM, so that the number of cumulative errors can be confirmed later.

Obtaining the angular displacement error data of the encoder of the one circle of the transferring conveyance belt and calculation of the amplified parameter and phase of the belt may be implemented in a case where an executive instruction is input by the external apparatus 38 shown in FIG. 10 or when the laser printer is first turned on in the morning.

Although the thickness of the actual belt depends on a manufacturing process of the belt, it is in a SIN state (sine wave state) in most cases. Hence, it is not always necessary to hold all of the angular displacement error data of one circle of the belt. At the time of measuring, data of the phase and amplitude from the standard position may be calculated and the detection angular displacement error data may be calculated from the data.

Because of this, it is not necessary to store the angular displacement error data every control cycle in the non-volatile memory. Since the angular displacement error data due to the belt thickness is generated by the amplified parameter and the phase the control can be done by preparing an area of only the volatile memory. In this case, the angular displacement error data due to the thickness variations of the belt are generated by the following formula at the time when the electric power is turned on and the driving motor 32 is started.

An angular speed variation value of the idler roller, $\Delta\theta$[rad], equals to $b\times\sin(2\times\pi\times ft+\tau)$]. The above-mentioned $\Delta\theta$ is calculated as corresponding to the control time from the belt mark so as to be stored in the RAM 602 which is a volatile memory, in turn.

When the transferring motor 302 is actually driven, as corresponding to the timing at which the mark sensor 35 detects the belt mark 34, a reference address of the RAM 602 is switched so as to read the data. The read data is added to the above-mentioned control target angular displacement so that feed back control is implemented without directly utilizing the influence of the belt thickness.

Figure 19:
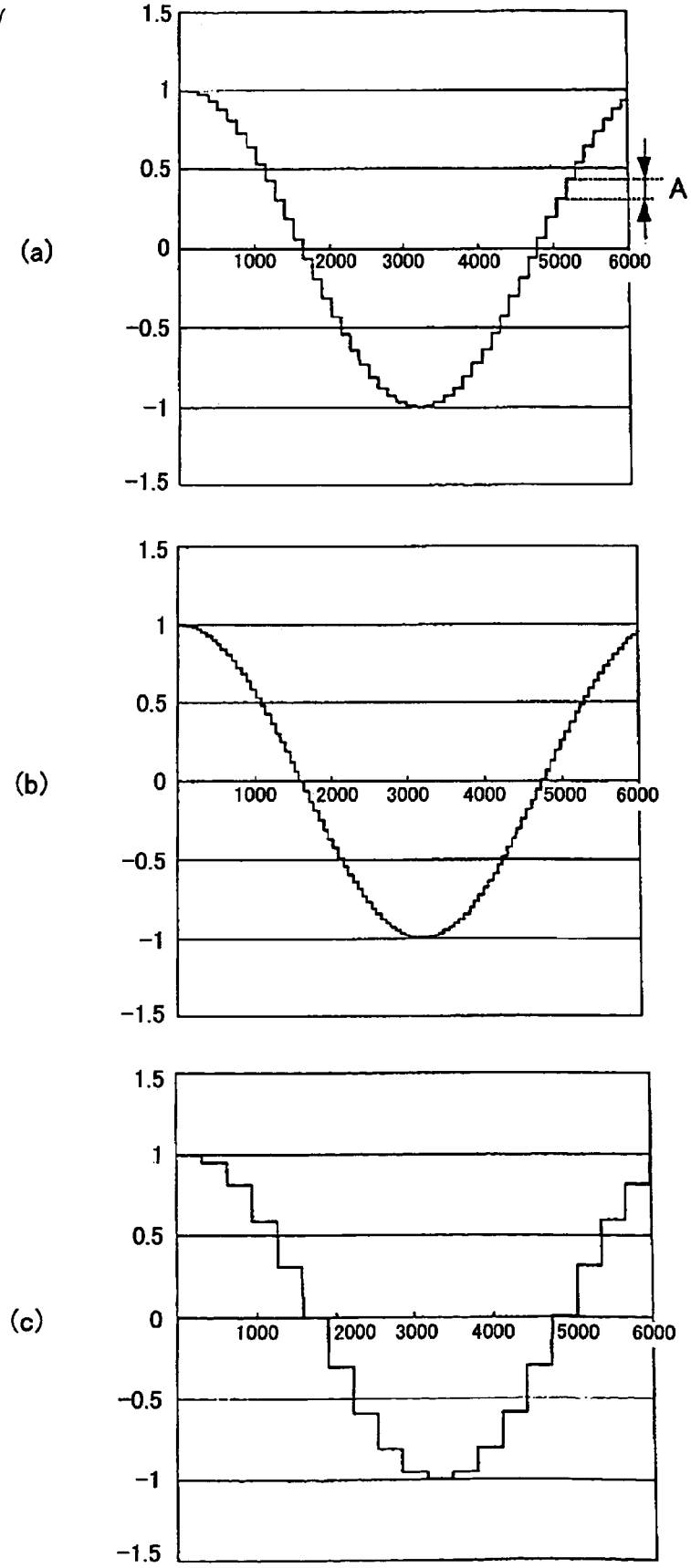
FIG. 19 is a graph showing an example of a control target value in a case where the control target value is changed 50 times, 100 times and 20 times per a single revolution of the belt.

In a case where only a peak value of the speed variation due to the thickness variation of the belt is required to be reduced, the angular displacement error data due to the thickness variation of the belt every control cycle are not necessary. Because of this, in order to reduce the memory area, it is possible to sufficiently reduce the peak value of the speed variation by generating the profile data of approximately 50 points per one circle (revolution) of the belt as shown in FIG. 19-(*a*) and renewing thickness profile data when the transferring belt arrives at respective points. In this case, the control target value is changed 50 times per one circle of the belt. "A" in FIG. 19 shows an object value variation amount per one time.

In addition, if the control target value is changed 100 times per one circle of the belt, a result shown in FIG. 19-(*b*) is obtained. If the control target value is changed 20 times per one circle of the belt, a result shown in FIG. 19-(*c*) is obtained.

Figure 20:
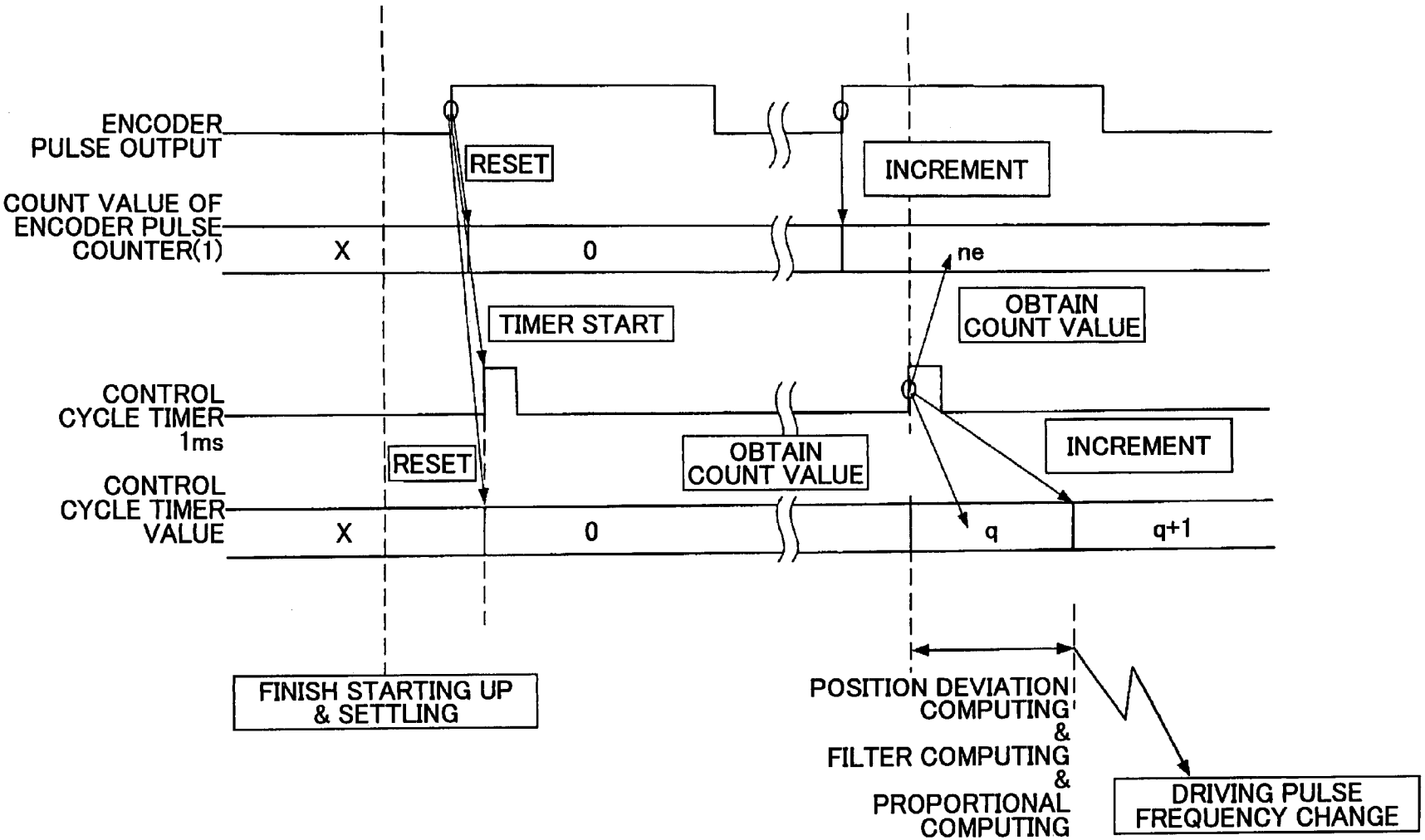
FIG. 20 is a timing chart for explaining a belt driving control operation by the embodiment of the present invention.
Figure 21:
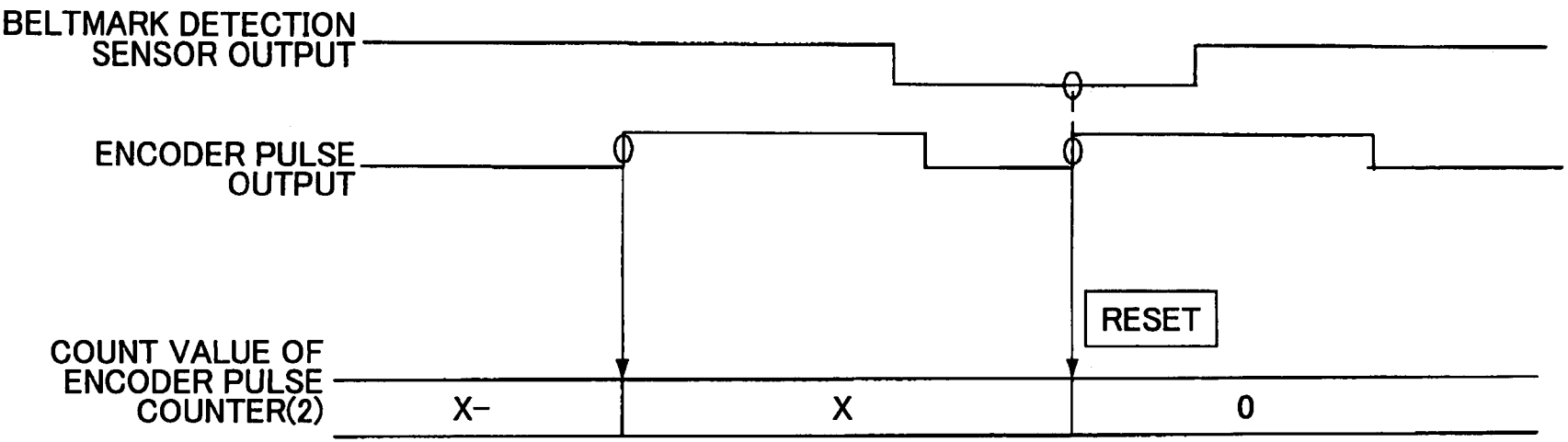
FIG. 21 is another timing chart for explaining the belt driving control operation according to the embodiment of the present invention.

FIG. 20 is a timing chart for explaining a belt driving control operation by the embodiment of the present invention. FIG. 21 is another timing chart for explaining the belt driving control operation by the embodiment of the present invention.

In FIG. 20, an incrementing process is applied to a count value of an encoder pulse counter (1) counting an encoder pulse output being output by the encoder 31 by a starting edge of an A phase of the encoder pulse output. In addition, the control cycle of this control process is 1 ms. Every interrupt sent to the CPU 601 by a control cycle timer, the incrementing process is applied to a count value of a control cycle timer counter.

A timer is started at the time when the starting edge of the encoder pulse is first detected after start-up and settling down of a driving motor are completed, and the count value of the control cycle timer counter is reset.

In addition, every interrupt sent to the CPU 601 by the control cycle timer, obtaining "ne" that is a count value of the encoder pulse counter (1), obtaining "q" that is the counter value of the control cycle timer counter, and the incrementing process are done.

The incrementing process is applied, as shown in FIG. 21, to a count value of an encoder pulse counter (2) as well as the count value of an encoder pulse counter (1) by the starting edge of the A phase of the encoder pulse output, so that the encoder pulse counter (2) is reset by the starting edge of the first encoder pulse at the time when the belt mark detection signal of the mark sensor 35 is input. Because of this, the encoder pulse counter (2) substantially counts a moving distance from the belt mark. As corresponding to this value, a reference address of the RAM 602 where the data of the control target profile of one circle of the belt are stored is switched.

Based on the count values of these encoder pulse counters (1, 2), the position deviation is calculated as follows.

$$E(n)=\theta 0\times q+(\Delta\theta-\Delta\theta 0)-\theta 1\times ne(\text{rad})$$

Here, the meanings of symbols in the above-mentioned formula are as follows.

e(n)[rad]: Position deviation calculated by sampling of this time $\theta 0$[rad]: moving angle per control cycle 1 [ms] ($=2\pi V\times 10^{-3}/L\pi$[rad])

$\Delta\theta$[rad]: rotational speed variation value of the idler roller [$=b\times\sin(2\times\pi\times ft+\tau)$] (table reference value)

$\Delta\theta 0$[rad]: $\Delta\theta$ value obtained first after the driving motor is started $\theta 1$[rad]: moving angle per one pulse of the encoder pulse ($=2\pi/p$[rad])

q: the counter value of the control cycle timer

V: belt linear velocity [mm/s]

L: diameter of right lower roller 66 [mm]

b: amplitude displaced by the belt thickness [rad]

$\tau$: phase by the belt mark of the belt thickness displacement [rad]

f: frequency of the belt thickness displacement [Hz]

In this embodiment, the diameter of the right lower roller 66 which is an idler roller where the encoder 31 is attached is 15.515 mm and the thickness of the transferring conveyance belt 60 is 0.1 mm.

The right lower roller 66 is rotated by the friction force with the transferring conveyance belt 60.

If approximately half thickness of the belt thickness is a core wire position when the right lower roller 66 is rotated, a substantial driving diameter L of the right lower roller 66 is as follows.

$$L'=15.515+0.1=15.615\ [\text{mm}]$$

In this embodiment, a resolution p of the encoder 31 is 30 pulses per one rotation.

Figure 22:
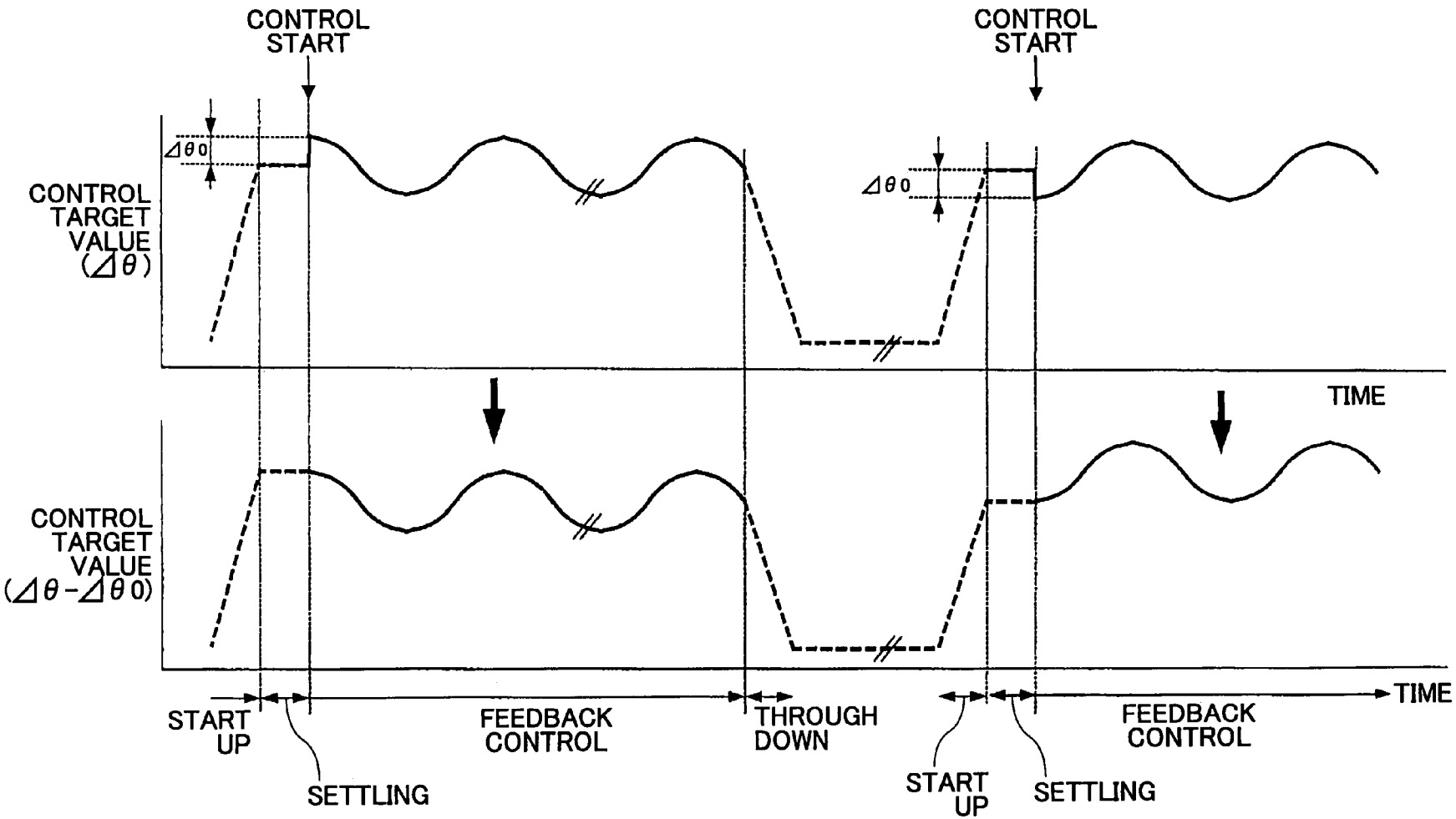
FIG. 22 is another timing chart for explaining the belt driving control operation according to the embodiment of the present invention.

In addition, in this embodiment, $\Delta\theta$ first obtained after the driving motor 32 is started is set to be $\Delta\theta 0$. By the formula "$\Delta\theta-\Delta\theta 0$", $\Delta\theta 0$ first obtained after the driving motor 32 is started is subtracted from $\Delta\theta$, and it is possible to ease a drastic speed variation at the time when the feed back control is started as shown in FIG. 22. The same value is used for $\Delta\theta 0$ when the transferring motor is rotated and renewed every start of the transferring motor.

Next, in order to avoid responding to the drastic position displacement, the following filter may be implemented in the computing the deviation. Filter type: Butterworth IIR low pass filter Sampling frequency: 1 KHz (equal to the control cycle)

Pass band ripple (Rp): 0.01 dB

Stop band edge attenuation (Rs): 2 dB

Pass band edge frequency (Fp): 50 Hz

Stop band edge frequency (Fs): 100 Hz

Figure 23:
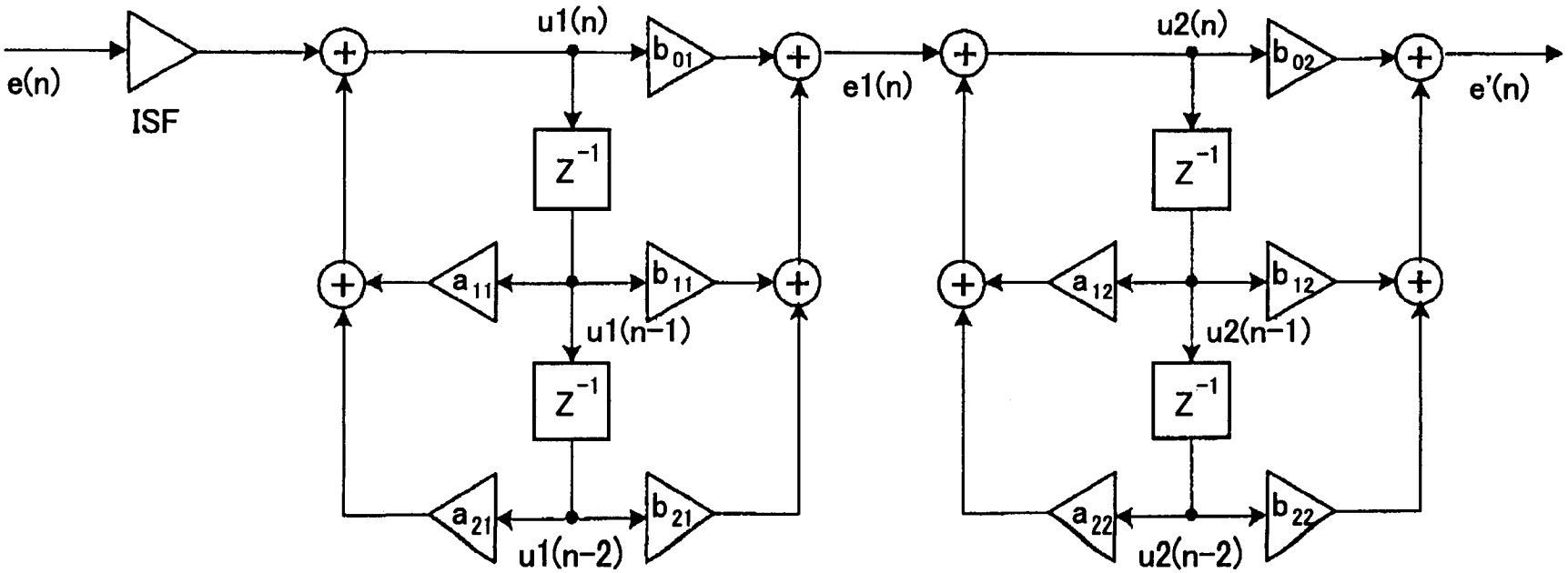
FIG. 23 is a block diagram showing a structure of filter computing used in the embodiment of the present invention.

FIG. 23 is a block diagram showing a structure of a filter for computing used in the embodiment of the present invention. FIG. 24 is a table showing filter coefficients of the filter used in the embodiment of the present invention;

Two filters having the same structure are cascade (two-step) connected. Intermediate nodes in the first step are defined as u1(n), u1(n-1), u1(n-2) and in the second step as u2(n), u2(n-1), u2(n-2). Here, the meanings of indexes are as follows.

(n): Present sampling (n-1): Sampling at one time before the present (n-2): Sampling at two times before the present The following program for computing is implemented every time the control timer interrupt is applied during the feed back process.

$$u1=(n)a11\times u1(n-1)+a21\times u1(n-2)+e(n)\times ISFe1(n)$$
$$=b01\times u1(n)+b11\times u1(n-1)+b21\times u1(n-2)u1(n-2)$$
$$=u1(n-1)u1(n-1)=u1(n)u2(n)=a12\times u2(n-1)+a22\times$$
$$u2(n-2)+e1(n)e'(n)=b02\times u2(n)+b12\times u2(n-1)+$$
$$b22\times u2(n-2)u2(n-2)=u2(n-1)u2(n-1)=u2(n)$$

Figure 25:
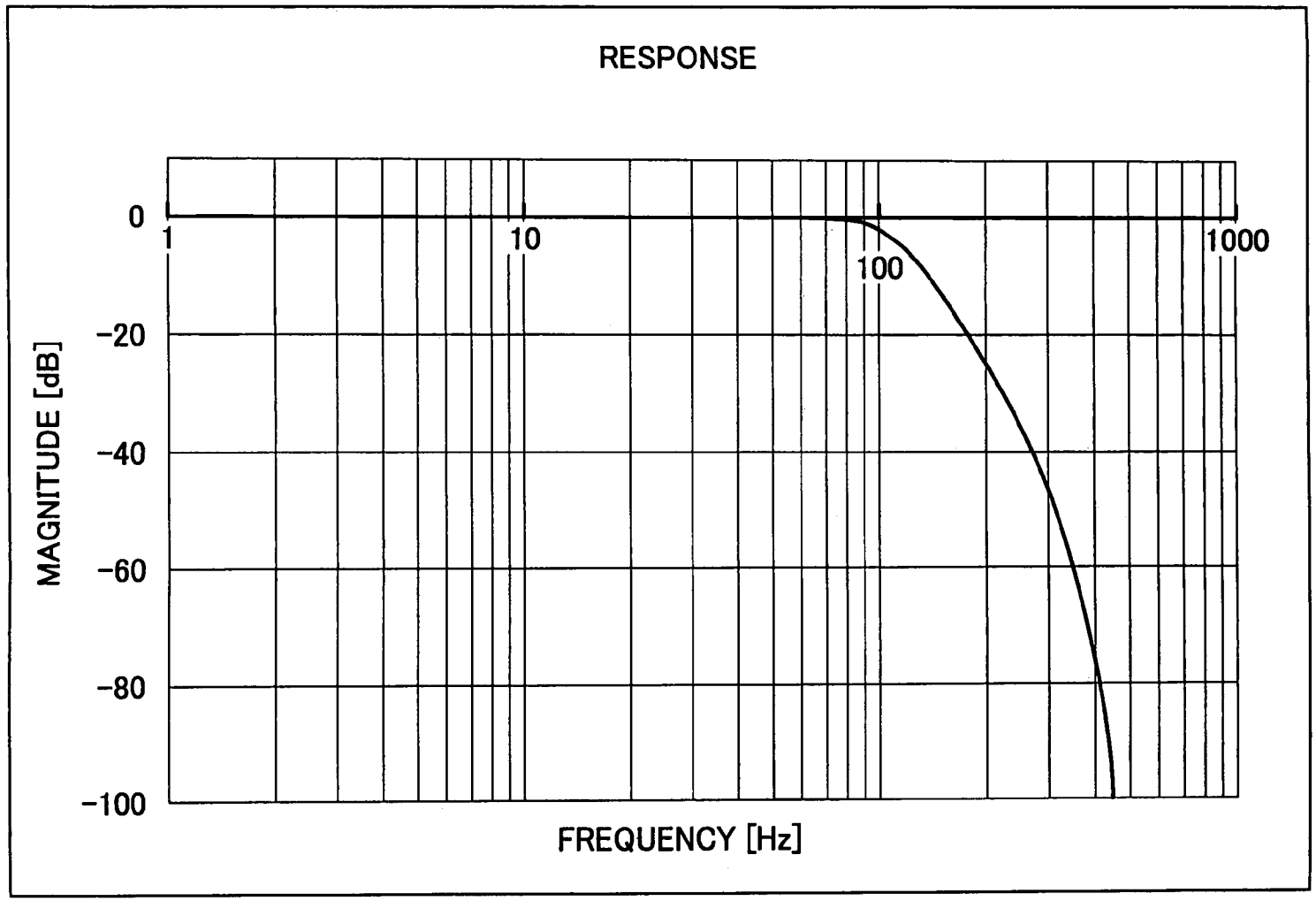
FIG. 25 is a graph showing an amplitude property of the filter used in the embodiment of the present invention.
Figure 26:
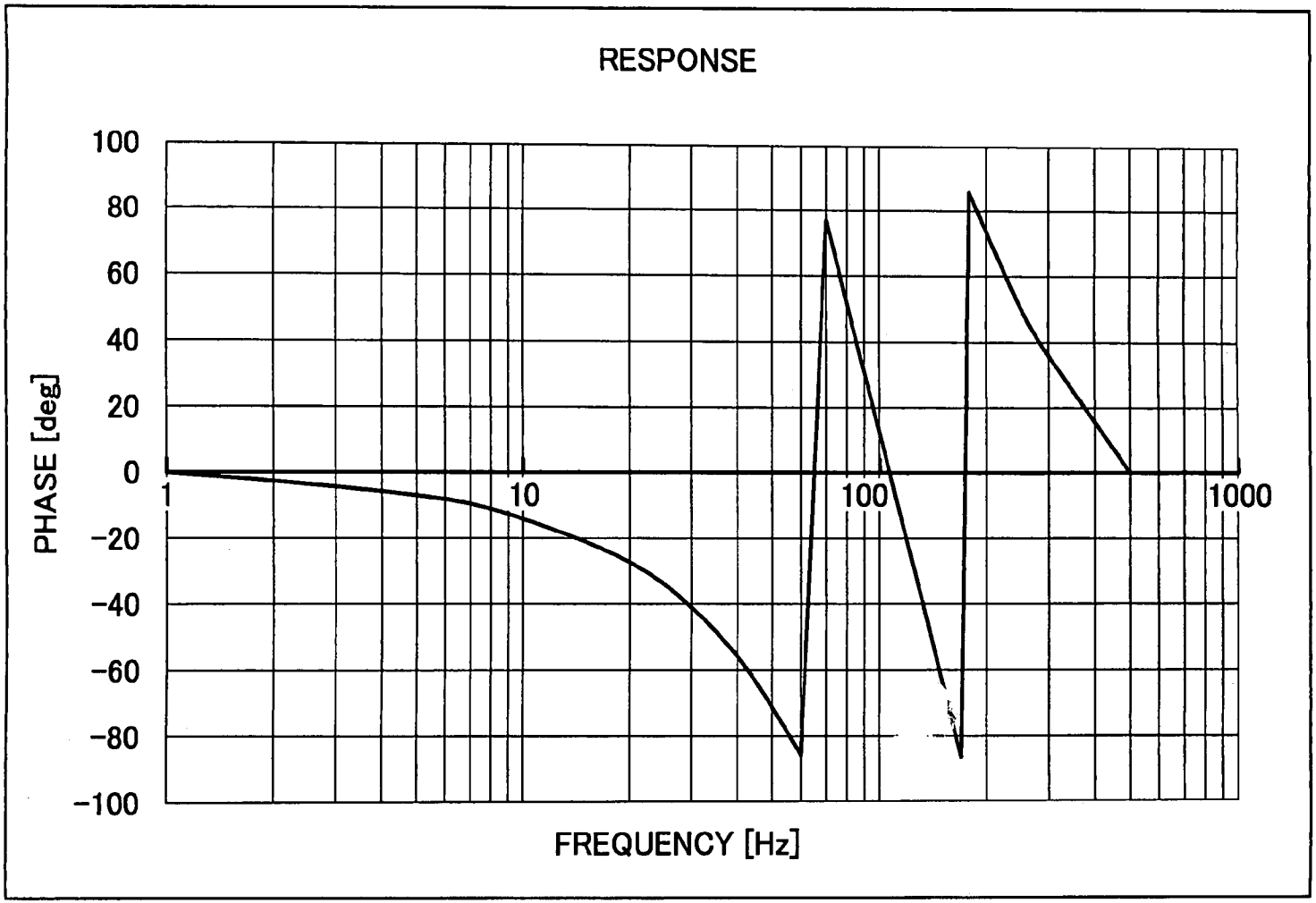
FIG. 26 is a graph showing a filter property of the filter used in the embodiment of the present invention.

FIG. 25 is a graph showing an amplitude property of the filter used in the embodiment of the present invention. FIG. 26 is a graph showing a filter phase property of the filter used in the embodiment of the present invention.

Next, a control amount to an object of the control is calculated. In a control block diagram, a PID control is considered as a position controller.

$$F(S)=G(S)\times E'(S)=Kp\times E'(S)+Ki\times E'(S)/S+Kd\times S\times E'(S) \quad (1)$$

Here, Kp is a proportional gain, Ki is an integral gain, and Kd is a derivative gain.

$$G(S)=F(S)\times E'(S)=Kp+Ki/S+Kd\times S \quad (1)$$

The following formula is obtained by bilinear conversion (S=(2/T)×(1−Z−1)/(1+Z−1)) the above-mentioned formula (1).

$$G(Z)=(b0+b1\times Z-1+b2\times Z-2)/(1-a1\times Z-1-a2\times Z-2) \quad (2)$$

Here, a1=0, a2=1, b0=Kp+T×Ki/2+2×Kd/T, b1=T×Ki−4×Kd/T, and b2=−Kp+T×Ki/2+2×Kd/T.

Figure 27:
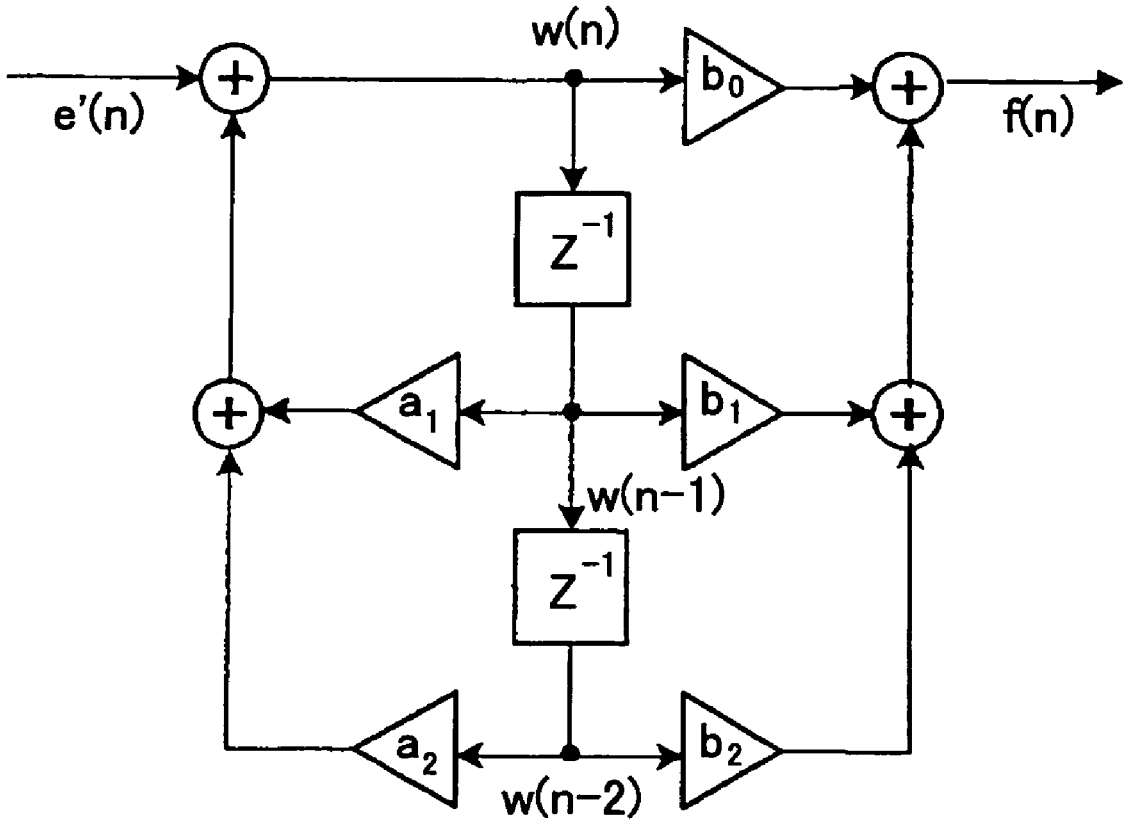
FIG. 27 is a block diagram showing a structure of filter computing of the first step in FIG. 19.

FIG. 27 is a block diagram of the above-mentioned formula (2). Here, e'(n) and f(n) show using E'(S) and F(S) as discrete data.

In FIG. 27, the following formula of the difference equation (general formula of PID control) is obtained by defining w(n), w(n-1), and w(n-2) as intermediate nodes.

$$w(n)=a1\times w(n-1)+a2\times w(\eta-2)+e'(n) \quad (3)$$

$$f(n)=b0\times w(n)+b1\times w(n-1)+b2\times w(n-2) \quad (4)$$

Here, the meanings of the indexes are as follows.

(n): Present sampling (n-1): Sampling at one time before the present (n-2): Sampling at two times before the present The proportional control is applied as a position controller so that the integral gain and the derivative gains are zero. Therefore, coefficients in FIG. 27 are as follows and the formulas (3) and (4) are simplified as the following formula (5).

a1=0 a2=1 b0=Kp b1=0 b2=−Kp $$w(n)=w(n-2)+e'(n)f(n)=Kp\times w(n)-Kp\times w(n-2)\rightarrow\therefore f(n)$$
$$=Kp\times e'(n) \quad (5)$$

In addition, the discrete data f0(n) corresponding to F(0)S in this embodiment is constant and is as follows.

$$f0(n)=6105\ [\mathrm{Hz}]$$

Therefore, the pulse frequency set in the driving motor is finally calculated by the following formula (6).

$$f'(n)=f(n)+f0(n)=Kp\times e'(n)+6105\ [\mathrm{Hz}] \quad (6)$$

Figure 28:
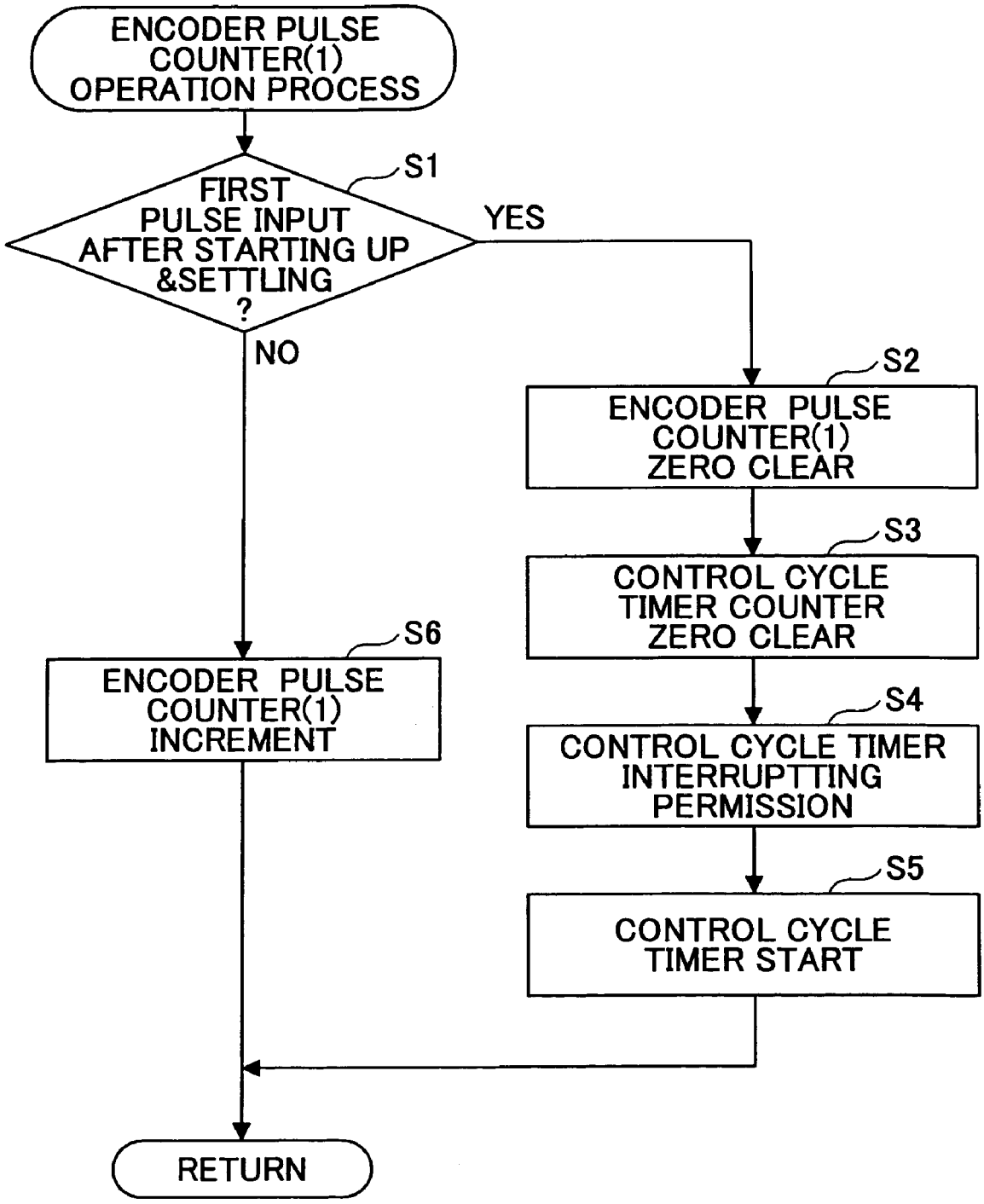
FIG. 28 is an operations flowchart of an encoder pulse counter (1)
Figure 29:
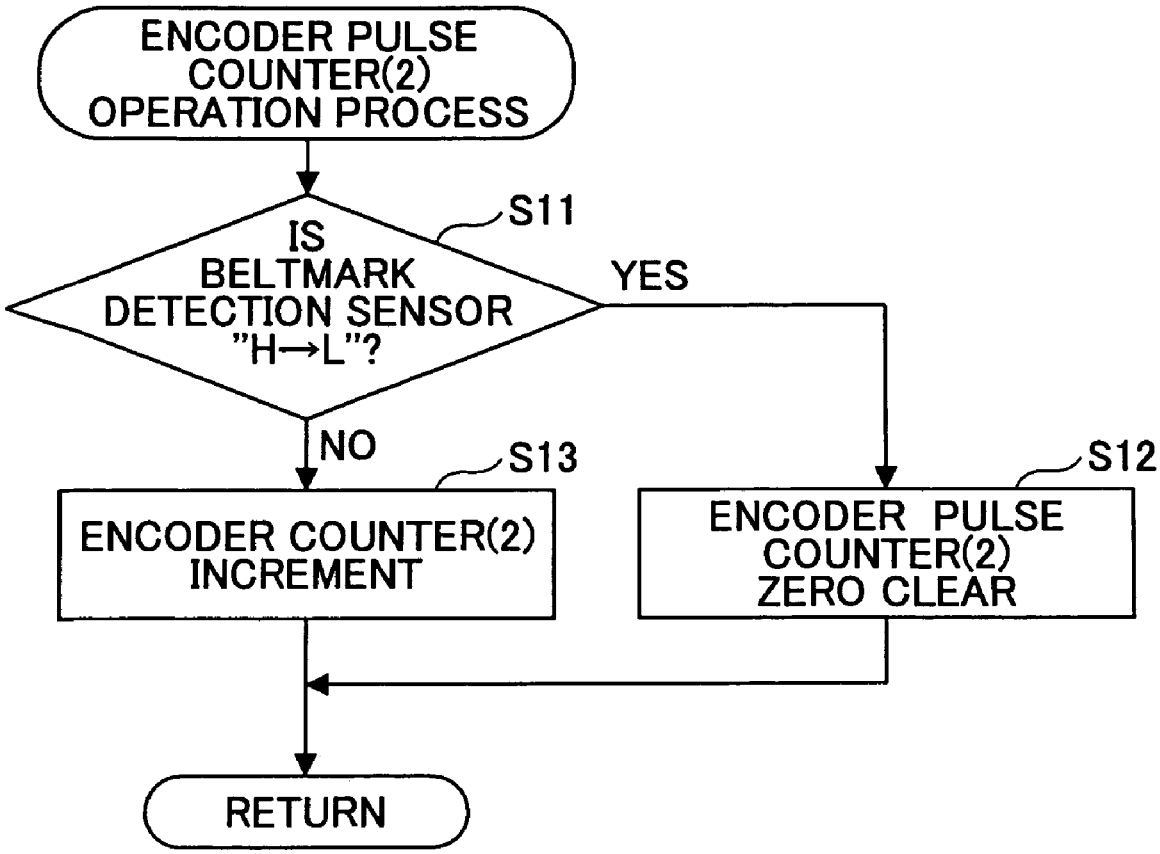
FIG. 29 is an operations flowchart of an encoder pulse counter (2)
Figure 30:
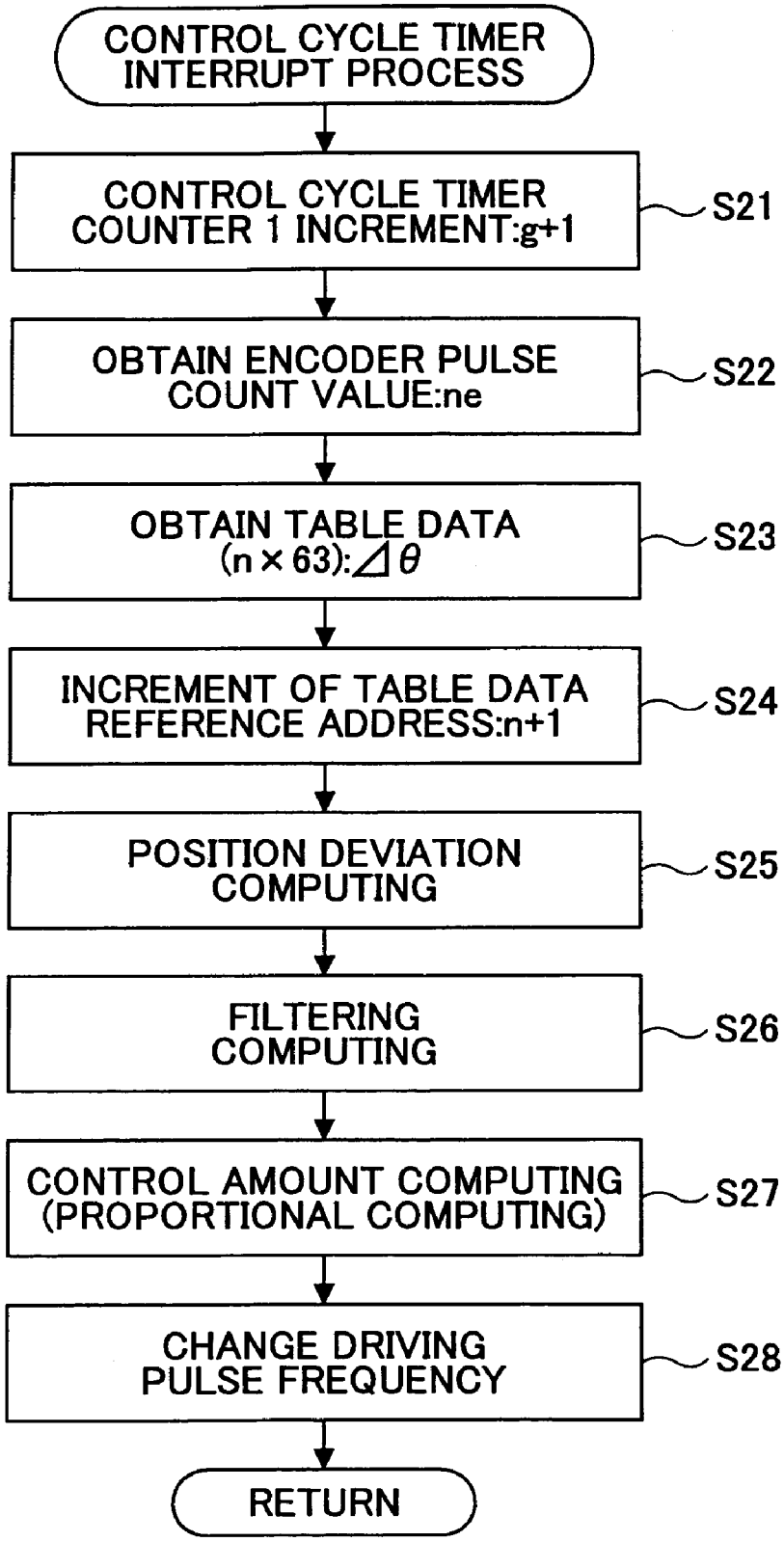
FIG. 30 is a flowchart of a control cycle timer interrupt process.

FIG. 28 is an operations flowchart of an encoder pulse counter (1). In FIG. 28 through FIG. 30, "S" means a step.

First, whether a first pulse input is after start-up and settling down is determined (S1). In a case of "YES" in step 1, an encoder pulse counter is made zero (cleared) (S2), the control cycle counter is made zero (S3), the interrupt of the control cycle timer is accepted (S4), and the control cycle timer is started (S5) so that the process is returned to a main routine not shown in FIG. 28.

In a case of "NO" in step 1, an increment process is applied to the encoder pulse counter (S6) and the process is returned to the main routine.

FIG. 29 is an operations flowchart of an encoder pulse counter (2).

When the encoder pulse is input, the state of the belt mark sensor is determined (S11). In a case of "YES" (HIGH) in step 11, the encoder pulse counter is made zero (S12). In a case of "NO" (LOW) in step 11, an incrementing process is applied to the encoder pulse counter(2) (S13) and the process is returned to the main routine.

FIG. 30 is a flowchart of a control cycle timer interrupt process.

First, an incrementing process is applied to the control cycle timer counter (S21), and then an encoder pulse count value n2 is obtained (S22). In addition, the table data are referred to so that Δθ is obtained (S23). The incrementing process is applied to the table reference address (S24). Then, control deviation computing is implemented by using these values and the filter is applied to the obtained position deviation (S26). Based on the result of the filter, calculation of the control amount (proportional computing) is performed (S27). A frequency of the driving pulse of the stepping motor is actually changed (S28) and the process is returned to the main routine.

By the above-mentioned control process, it is possible to properly perform control whereby the variation of the belt conveyance speed generated by the thickness variation of the transferring conveyance belt is made stable, at low cost and as corresponding to high image quality.

The present invention is not limited to the above-discussed embodiments, but variations and modifications may be made without departing from the scope of the present invention.

For example, the above-discussed embodiment of the present invention is applied to the belt driving apparatus of the tandem type laser printer wherein the photosensitive drums 11Y, 11M, 11C and 11K are arranged on the transferring conveyance belt 60. However, an image forming apparatus and a belt driving apparatus to which the present invention is applied is not limited to having this structure.

The present invention can be applied to any belt driving apparatus as long as the image forming apparatus has a belt driving apparatus where the endless belt wound around by plural rollers is rotated by at least one of the rollers.

In addition, in the above-discussed embodiment, the present invention is applied to a direct transferring type color printer where the transferring paper is conveyed by the transferring belt 60 and four color toner images from the photosensitive bodies in turn are transferred onto the transferring paper. However, the present invention can be applied to an intermediate transferring belt driving apparatus of the indirect transferring type color printer wherein four color toner images are transferred onto the intermediate transferring belt as separate images and then transferred onto the transferring paper where the four colors images are stacked.

In addition, in the above-mentioned embodiment, a laser light is used as an exposure light source. However, the present invention is not limited to this. For example, an LED array may be used as a light source.

This patent application is based on Japanese Priority Patent Application No. 2005-47909 filed on Jan. 25, 2005, the entire contents of which are hereby incorporated by reference.

What is claimed is:

1. A belt driving control apparatus, the belt driving control apparatus having an endless belt, a driving roller driving the endless belt, a driving motor driving the driving roller, at least one idler roller being dependent on the endless belt, and an encoder attached to one of the idler roller, the belt driving control apparatus having a structure where a control target value of the driving motor is set so that an effective speed of the endless belt is constant and the driving motor is drive-controlled so that the control target value is satisfied, the belt driving control apparatus comprising:

a mark detection part configured to detect a mark provided on the endless belt as a standard position;

an angular displacement error detection part configured to detect an angular displacement error of the encoder generated by thickness variations of the endless belt;

a first computing part configured to calculate a maximum amplitude and a phase of a wave of the thickness variations of the endless belt at the mark from the angular displacement error of the encoder obtained by the angular displacement error detection part;

a second computing part configured to calculate correction data corresponding to a distance from the mark based on a value stored in a non-volatile memory;

a storage device configured to store the calculation result of the first computing part and the correction data; and a driving motor control part configured to make speed variations due to thickness displacement of the endless belt stable by adding the correction data to the control target value for driving control at the time of driving the driving motor;

wherein the first computing part implements a moving average process and a revolution average process of data of the angular displacement error of the encoder detected by a plurality of revolutions of the endless belt so that data of the angular displacement error of the encoder of one revolution of the belt is calculated, and a phase and a maximum amplitude at the mark of the wave of the thickness displacement of the endless belt are calculated from data of the calculated angular displacement error.

2. The belt driving control apparatus as claimed in claim 1, wherein the first computing part calculates from data of the angular displacement error detected by the encoder of the plural revolutions of the belt detected at an optional timing.

3. The belt driving control apparatus as claimed in claim 1, wherein the first computing part calculates from data of the angular displacement error of the encoder of the plural revolutions of the belt detected just after electric power is turned on.

4. The belt driving control apparatus as claimed in claim 1, wherein, in a case where the phase and the maximum amplitude at the calculated mark are out of a predetermined range, the first computing part determines an error, stops storing a calculated error in the non-volatile memory and sets a parameter of the phase and the maximum amplitude at the mark to zero.

5. The belt driving control apparatus as claimed in claim 4, wherein, in a case where the error is determined, accumulation of the number of generated errors is stored in the non-volatile memory, and the number of the generated errors is confirmed at an optional timing.

6. The belt driving control apparatus as claimed in claim 1, wherein an operation of a heat source which may cause the speed variation of the endless belt is stopped when the angular displacement error of the encoder is detected by the angular displacement error detection part.

7. The belt driving control apparatus as claimed in claim 1, wherein the endless belt is no-load run until the driving of the endless belt is made stable before the angular displacement error of the encoder is detected by the angular displacement error detection part.

8. A belt driving control apparatus, the belt driving control apparatus having an endless belt, a driving roller driving the endless belt, a driving motor driving the driving roller, a plurality of idler rollers being dependent on the endless belt, and an encoder attached to one of the idler rollers, the belt driving control apparatus having a structure where a control target value of the driving motor is set so that an effective speed of the endless belt is constant and the driving motor is drive-controlled so that the control target value is satisfied, the belt driving control apparatus comprising:

mark detection means for detecting a mark provided at the endless belt as a standard position;

angular displacement error detection means for detecting an angular displacement error of the encoder generated by thickness variations of the endless belt;

first computing means for calculating a maximum amplitude and a phase of a wave of the thickness variations of the endless belt at the mark from the angular displacement error of the encoder obtained by the angular displacement error detection means;

a non-volatile memory configured to store the calculation result of the first computing means;

second computing means for calculating correction data corresponding to a distance from the mark based on a value stored in the non-volatile memory;

a volatile memory configured to store the correction data; and driving motor control means for making speed variations due to thickness displacement of the endless belt stable by adding the correction data to the control target value for driving control at the time of driving the driving motor;

wherein the first computing means implements a moving average process and a revolution average process of data of the angular displacement error of the encoder detected by a plurality of revolutions of the endless belt so that data of the angular displacement error of the encoder of one revolution of the belt is calculated, and a phase and a maximum amplitude at the mark of the wave of the thickness displacement of the endless belt is calculated from data of the calculated angular displacement error.

9. An image forming apparatus, comprising:

a belt driving control apparatus, the belt driving control apparatus having an endless belt, a driving roller driving the endless belt, a driving motor driving the driving roller, a plurality of idler rollers being dependent on the endless belt, and an encoder attached to one of the idler rollers, the belt driving control apparatus having a structure where a control target value of the driving motor is set so that an effective speed of the endless belt is constant and the driving motor is drive-controlled so that the control target value is satisfied, the belt driving control apparatus comprising:

a mark detection part configured to detect a mark provided on the endless belt as a standard position;

an angular displacement error detection part configured to detect an angular displacement error of the encoder generated by thickness variations of the endless belt;

a first computing part configured to calculate a maximum amplitude and a phase of a wave of the thickness variations of the endless belt at the mark from the angular displacement error of the encoder obtained by the angular displacement error detection part;

a non-volatile memory configured to store the calculation result of the first computing part;

a second computing part configured to calculate correction data corresponding to a distance from the mark based on a value stored in the non-volatile memory;

a volatile memory configured to store the correction data; and a driving motor control part configured to make speed variations due to thickness displacement of the endless belt stable by adding the correction data to the control target value for driving control at the time of driving the driving motor;

wherein the first computing part implements a moving average process and a revolution average process of data of the angular displacement error of the encoder detected by a plurality of revolutions of the endless belt so that data of the angular displacement error of the encoder of one revolution of the belt is calculated, and a phase and a maximum amplitude at the mark of the wave of the thickness displacement of the endless belt is calculated from data of the calculated angular displacement error.

* * * * *